US010121396B2

(12) United States Patent
Taylor et al.

(10) Patent No.: US 10,121,396 B2
(45) Date of Patent: Nov. 6, 2018

(54) LED BILLBOARD SYSTEM

(71) Applicant: METROMEDIA TECHNOLOGIES, INC., New York, NY (US)

(72) Inventors: Curtis Taylor, Chagrin Falls, OH (US); Matthew Hanson, Chagrin Falls, OH (US); William Ishida, Chagrin Falls, OH (US); Sam Shaprio, Chagrin Falls, OH (US); Michael Kakoyiannis, New York, NY (US)

(73) Assignee: Metromedia Technologies, Inc., New York, NY (US)

( * ) Notice: Subject to any disclaimer, the term of this patent is extended or adjusted under 35 U.S.C. 154(b) by 5 days.

(21) Appl. No.: 15/421,936

(22) Filed: Feb. 1, 2017

(65) Prior Publication Data

US 2017/0221392 A1 Aug. 3, 2017

Related U.S. Application Data

(60) Provisional application No. 62/290,105, filed on Feb. 2, 2016.

(51) Int. Cl.

| | |
|---|---|
| ***G09F 9/33*** | (2006.01) |
| ***G09F 9/302*** | (2006.01) |
| ***G09F 9/30*** | (2006.01) |
| ***G09F 15/00*** | (2006.01) |
| *F21Y 105/16* | (2016.01) |
| *F21Y 115/10* | (2016.01) |

(52) U.S. Cl.

CPC ..... *G09F 9/3026* (2013.01); *G09F 9/301* (2013.01); *G09F 9/33* (2013.01); *G09F 15/0037* (2013.01); *F21Y 2105/16* (2016.08); *F21Y 2115/10* (2016.08)

(58) Field of Classification Search

CPC ..... G09F 9/3026; G09F 9/301; G09F 9/33

See application file for complete search history.

(56) References Cited

U.S. PATENT DOCUMENTS

| | | | | |
|---|---|---|---|---|
| 2004/0163291 | A1* | 8/2004 | Pena | G09F 21/02 40/591 |
| 2009/0289160 | A1* | 11/2009 | Kludt | F16B 2/12 248/226.11 |
| 2011/0019348 | A1* | 1/2011 | Kludt | F16B 2/12 361/679.01 |
| 2011/0051409 | A1* | 3/2011 | Nearman | G09F 9/33 362/231 |
| 2011/0057215 | A1* | 3/2011 | Chen | G09F 7/002 257/98 |
| 2011/0089824 | A1* | 4/2011 | Zheng | G09F 9/33 313/512 |
| 2012/0013806 | A1 | 1/2012 | Hsieh | |
| 2014/0192530 | A1* | 7/2014 | Liu | H05K 5/02 362/249.02 |

(Continued)

OTHER PUBLICATIONS

International Search Report for PCT/U2017/015996 dated Apr. 13, 2017.

*Primary Examiner* — Gary C Hoge

(74) *Attorney, Agent, or Firm* — Abelman, Frayne & Schwab

(57) ABSTRACT

A LED billboard system that is adapted to mount to pre-existing or future billboard structures such that when the LED panels are switched on, the LED billboard can be illuminated from behind.

26 Claims, 28 Drawing Sheets

(56) References Cited

U.S. PATENT DOCUMENTS

| | | | | |
|---|---|---|---|---|
| 2014/0267896 | A1* | 9/2014 | Cox | G09F 9/3026 348/383 |
| 2015/0098188 | A1* | 4/2015 | Cox | H05K 7/20963 361/690 |
| 2015/0243196 | A1 | 8/2015 | Hall | |
| 2015/0310777 | A1 | 10/2015 | Cox et al. | |

* cited by examiner

LED BILLBOARD SYSTEM

The present invention is directed to lighting systems. The invention finds particular attention to light emitting diode (LED)-illuminated display signs having a mounting system, where the LED illumination system can be adapted to mount on conventional, pre-existing structures, and will be described with particular reference thereto. However, it is to be appreciated that the present exemplary embodiment is also amenable to other like applications.

BACKGROUND ON THE INVENTION

Billboards are structures typically used to display graphics, menus, or other information in outdoor locations. These billboards may be free-standing (e.g., along highways, roads, etc.) or installed on other structures (e.g., on the side of a building, on top of a stadium, on the side of a truck, etc.). During daylight hours, the sign can be visible without any additional lighting structures.

Traditional billboards usually measure 14 feet by 48 feet and contain lighting structures installed on the front of the billboard structure that are directed toward the sign in order to light the sign and improve its visibility, for example, during nighttime hours or bad weather conditions.

With new technology, lighting systems, such as the LED, have been introduced.

In view of the prior aft, there remains a need for an LED billboard system that can easily and conveniently be attached to pre-existing and future billboard structures.

BRIEF DESCRIPTION OF THE INVENTION

Disclosed in various embodiments are LED billboard systems that are useful for attachment to pre-existing billboard structures to provide LED-illuminated media and will be described with particular reference thereto. However, it can be appreciated that the LED billboard system of the present invention can be attached to other structures (e.g., walls, roofs, cars, trucks, boats, trains, airplanes, trailers, doors, etc.). Furthermore, although the light mounting system described herein is particularly directed to LED lighting system, it will be appreciated that other types of lighting systems can be used (e.g., plasma lighting systems, incandescent lighting systems, halogen lighting systems, florescent lighting systems, etc.).

In one non-limiting embodiment of the present invention, there is provided a novel structure for LED lighting systems which may be attached to billboard structures.

In another non-limiting embodiment of the present invention, there is provided an assembled LED panel unit which, when on billboard structures or on other structures, will serve to illuminate the billboard graphic from behind.

In yet another non-limiting embodiment of the present invention, there is provided a novel lighting system for illumination of billboard graphics for the purpose of illuminating the billboard graphic as needed or required, such as, but not limited to, usually in low visibility conditions (e.g., dusk, dawn, nighttime hours, mist conditions, rain conditions, snow conditions, etc.).

In still yet another non-limiting embodiment of the present invention, there is provided one or more assembled LED panel units which can easily and conveniently be attached to pre-existing billboard structures.

These and other objects, features, and advantages of the present invention will become apparent from the subsequent description taken in conjunction with the accompanying drawings.

BRIEF DESCRIPTION OF THE DRAWINGS

Reference may now be made to the drawings, which illustrate various nonlimiting embodiments that the invention may take in physical form and in certain pans and arrangements of parts wherein.

DETAILED DESCRIPTION OF NON.LIMITING EMBODIMENTS

Figure 1:
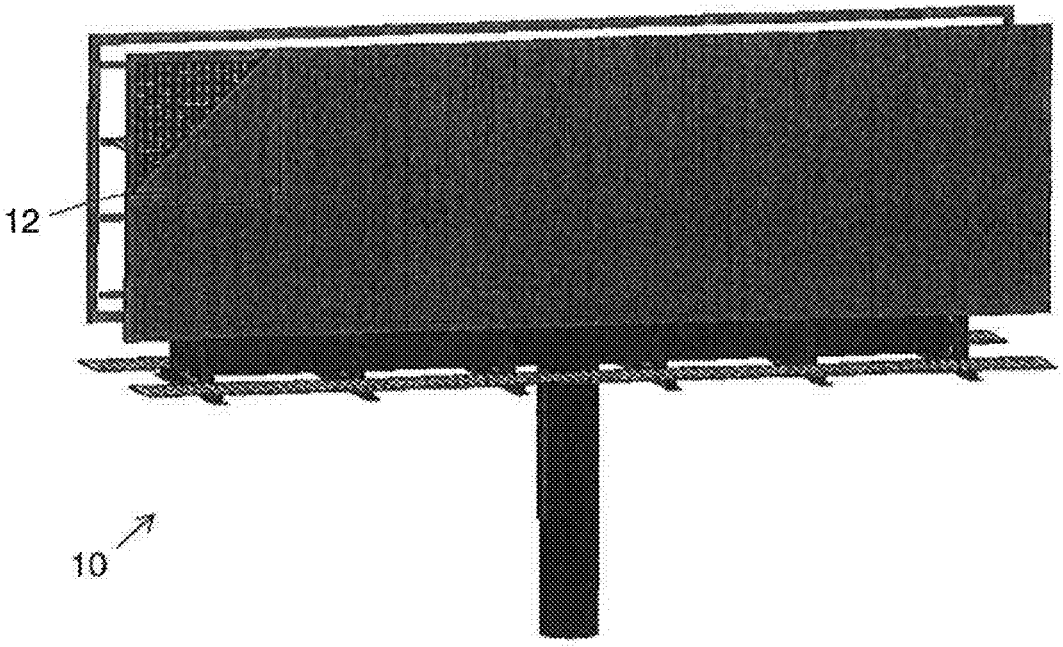
FIG. 1 is a perspective illustration of the LED billboard system in use according to one non-limiting aspect of the present invention.

An exemplary non-limiting embodiment of the present invention includes a LED billboard system, suitable for attachment to pre-existing billboard structures. Although the LED billboard system of the present invention described herein is illustrated in an exemplary embodiment as being associated with pre-existing billboard structures, the LED billboard system can also be used with pre-existing and future billboard structures and/or any non-standard size billboard structure. It can also be appreciated that the LED billboard system of the present invention can be attached to other structures (e.g., walls, roofs, cars, trucks, boats, airplanes, trailers, doors, etc.).

Referring now to the drawings wherein the showing is for the purpose of illustrating non-limiting embodiments of the invention only and not for the purpose of limiting the same, FIGS. 1-43 illustrate various non-limiting versions of a LED billboard system in accordance with the present invention. The LED billboard system of the present invention is compatible with being attached to pre-existing or future billboard structures; however, it can be appreciated that the LED billboard system can be configured to be attached to other or additional signage structures (e.g., an outdoor wall of a building, the side of a truck, side of a train, etc.).

Optionally, the LED billboard system of the present invention can be used for indoor applications (e.g., an indoor wall of a building, etc.); however, this is not required.

According to one non-limiting aspect of the present invention, an LED billboard system optionally comprises panel subunits, LED light boards, baffles, and a graphic wrap (e.g., vinyl graphic wrap, etc.); however, this is not required. Generally, the assembled LED billboard system can be attached or retrofitted to fit pre-existing billboard structures for the purpose of illuminating the billboard display as needed or required, usually in low visibility conditions (e.g., during dusk, nighttime hours, etc.).

In use, as best seen in FIG. 1, the LED billboard system 10 is optionally attached to the support skeleton of a pre-existing billboard structure and covered by a graphic wrap 12. The material used to form the graphic wrap is non-limiting and can be fabric or any other or additional suitable material. The configuration and thickness of the graphic wrap is also non-limiting.

Figure 2:
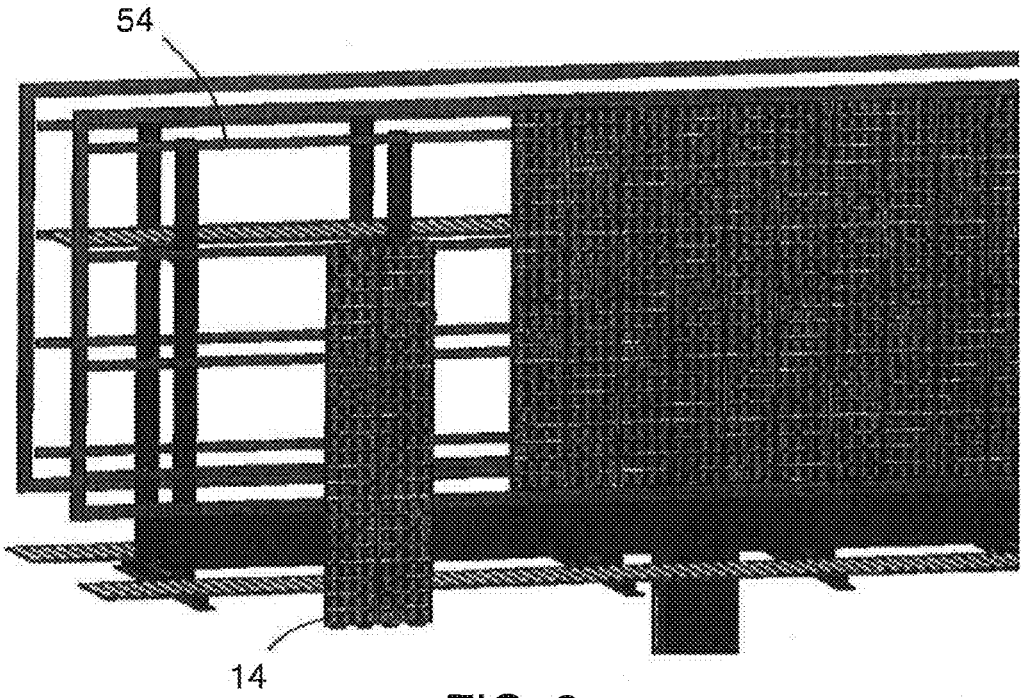
FIG. 2 is a perspective illustration of the partially assembled panel units according to another non-limiting aspect of the present invention.

As best seen in FIG. 2, the LED billboard system 10 optionally comprises one or more assembled panel units 14. The overall dimensions of one non-limiting assembled panel unit are about 14' in height by about 4' in width and about 6" in depth. However, it can be appreciated that the assembled panel unit can have other dimensions. The unique structure of the assembled panel unit optionally permits easy and convenient attachment to pre-existing billboard structural crossbars 54.

Generally, twelve assembled panel units can be assembled to fit a standard 14' by 48' billboard; however, this is not required. As can be appreciated, the number of assembled panel units can be varied to properly fit the structure and size of any preexisting billboard. As such, the LED billboard system panels of the present invention are adaptable to pre-existing and future billboard structures, or for used with many other structures.

Figure 3:
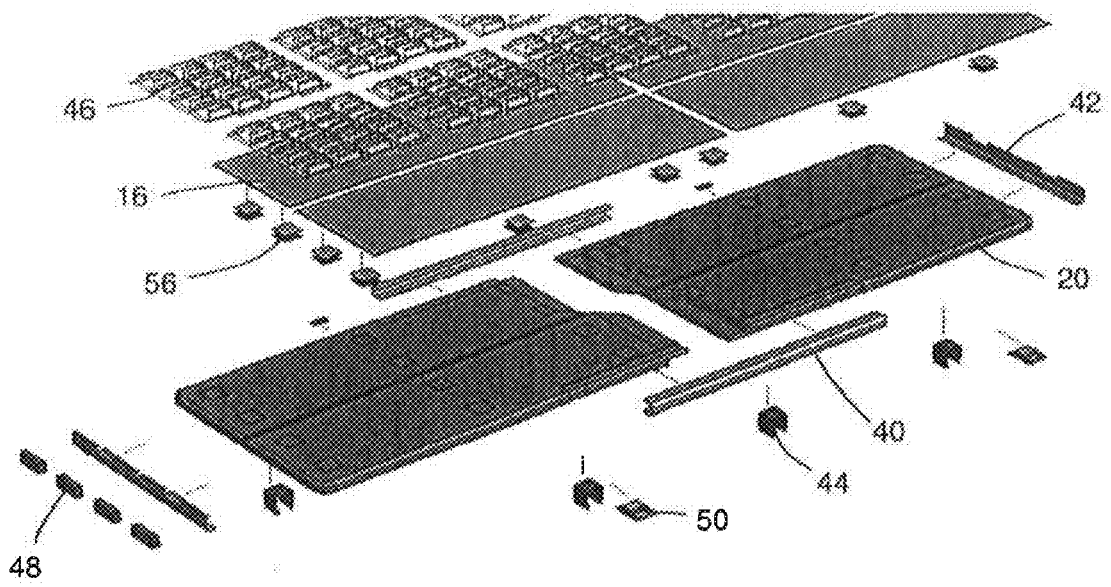
FIG. 3 is an exploded view of an assembled panel unit of FIG. 2 according to another non-limiting aspect of the present invention.

FIG. 3 is an exploded perspective illustration of an assembled panel unit 14 according to one non-limiting aspect of the present invention. One assembled panel unit can optionally comprise baffles 46, LED light boards 16, adhesive means 56, buckle latches 50, blow-molded panels 20, top-bottom brackets 42, transformers 48, PBU clips 44, and side brackets 40; however, this is not required. In one non-limiting embodiment, one assembled panel unit comprises two panel subunits; however, this is not required.

In one non-limiting embodiment, the material of light board 16 is cut acrylic and aluminum; however, it can be appreciated that other or additional materials can be used. LED light strips are optionally provided thereon. As can be appreciated, the light board can be formed of other or additional materials. The LED light strips can include one or more LEDs, one or more circuit boards with control circuits, and/or one or more electrodes; however, this is not required.

In one non-limiting embodiment of the present invention, the LED light board can comprise an edge-lit configuration wherein one or more LED light strips can be arranged in a linear fashion along one edge of a light board. The back surface (i.e., the surface of the light board facing away from the overlaying cover graphic) of the light board can provide a scattering portion for the purpose of reflecting or diffusing light toward the front surface of said light board such that it is emitted in a general direction away from the billboard through the overlaying cover graphic.

The light emitted from the LEDs can be partially guided, spread across the emissions area, and redirected out of the light board perpendicular to the light board. Many types of methods achieve such function, including etched lines or dots on the light board, and wedged light boards for controlled total internal reflections with light emissions. The light from the LED entering the light board can be spread by various diffusion mechanisms such that each LED covers a certain area with light with overlapping regions between the LEDs. The structural diffusing properties of the light board can be used to provide a uniform intensity profile across the surface of the light board; however, it can be appreciated that a non-uniform intensity profile can also be formed.

Edge-lit backlight LED panels, when used, can provide several advantages, namely improved efficiency and lower cost. According to one non-limiting embodiment of the present invention, a large number of LED light boards can be used to provide the necessary backlighting for the billboard.

In another non-limiting embodiment of the present invention, the LEDs can be distributed across the back surface (i.e., the surface of the light board facing away from the overlaying cover graphic) of the light board for the purpose of providing different lighting outputs in the same direction of the light board.

In yet another non-limiting embodiment of the present invention, the LEDs can be distributed across the front surface (i.e., the surface of the light board which faces the overlaying cover graphic) of the light board. In this embodiment, the light board is not transparent or light guiding; however, this is not required. Furthermore, the light board can be a circuit board or a board with LEDs mounted thereon; however, this is not required. The arrangement of LEDs on the light board is non-limiting. The LEDs can be white, single-colored or multi-colored and can be controlled as a single unit, or can be controlled individually.

The use of LED light boards in displays provides a number of advantages over other types of lighting systems: 1) they are easily electronically controlled; 2) they last longer than incandescent lighting; 3) they radiate "cold light" meaning they generate less heat than traditional lighting systems; 4) they are energy efficient in that they consume less energy to produce brighter illuminated displays; 5) the light intensity emitted can be controlled; and/or 6) the color of lighting can be controlled and/or varied, etc. In addition, when in use, the LED light boards of the present invention can be used to permit an even distribution of light, illuminating the billboard graphic from behind; however, uneven and/or variable distribution of the lighting can also be achieved.

The light-diffusion properties provided by the LED billboard system of the present invention can optionally be such that the diffused angular distribution of light can be symmetrical in the x (i.e., the horizontal direction) and the (i.e., the vertical direction) directions; however, this is not required. As can be appreciated, the angular distributions can be different in the x and the y directions. For example, it may be desirable to have a larger horizontal viewing angle than the vertical viewing angle.

The overall dimensions of one non-limiting LED light board are about 7' in height by about 2' in width and about 0.25" in depth. However, it can be appreciated that the LED light board can have other dimensions.

According to one non-limiting embodiment of the present invention, the LED light board can optionally include a light board portion, with optional scattering features provided thereon such as an etched pattern formed on one side of the light board, and a back diffuser portion. An LED light strip can optionally be placed along one edge of the light board such that the LED light outputs are coupled into the light board. The scattering features of the light board can optionally be designed to provide a spatially uniform array of light. Along two sides of the light plate perpendicular to the LED light strip, a tube (e.g., metal tube, composite tube, etc.) can be mounted to each side wherein the tubes can be connected to the LEDs and act as positive and negative electrodes. Thus, the LED light boards which form a complete panel unit can have a single pair of electrodes for connection to a single power supply; however, this is not required. The wire and the tubes can be in intimate contact such that the LED can be driven by the power supply connected to the wires; however, this is not required.

Because the LED billboard system of the present invention is comprised of one or more individual LED light boards, each LED light board can be operated independently (i.e., controlled by an external controller); however, this is not required. As such, each LED light board can be separately operated such that the color and/or intensity can be controlled by a computer creating a multitude of visual effects (e.g., flashing panels, vertical or horizontal movement of columns and rows of panels, etc.). A controller can be added to each LED light panel or to a group of neighboring LED light panels; however, this is not required. Alternatively, each LED light panel can have its own controller. The type of controller used in the LED light panel is non-limiting. The one or more controllers can be coupled to a command unit and a programmer unit; however, this is not required.

Figure 4A:
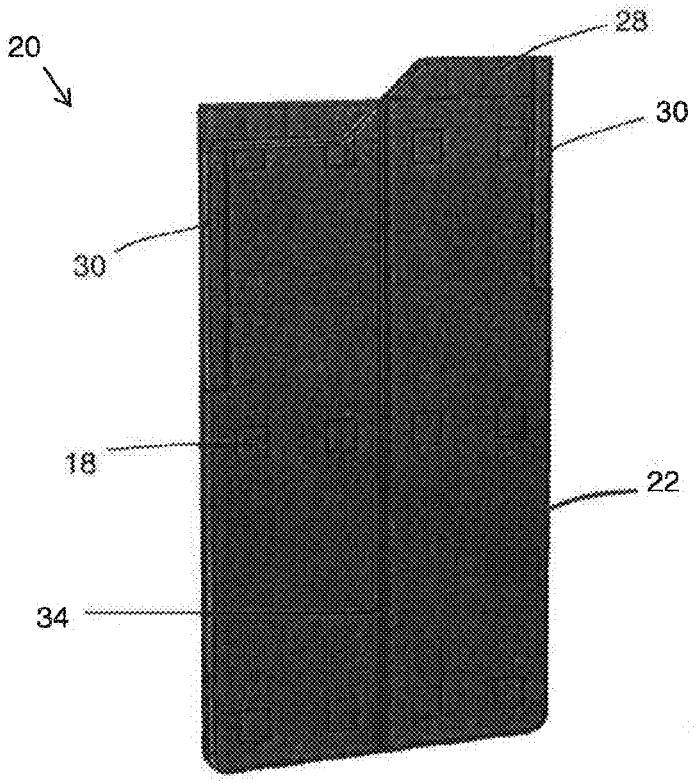
FIG. 4*a* is a perspective illustration of the front surface of a panel subunit according to another non-limiting aspect of the present invention.
Figure 4B:
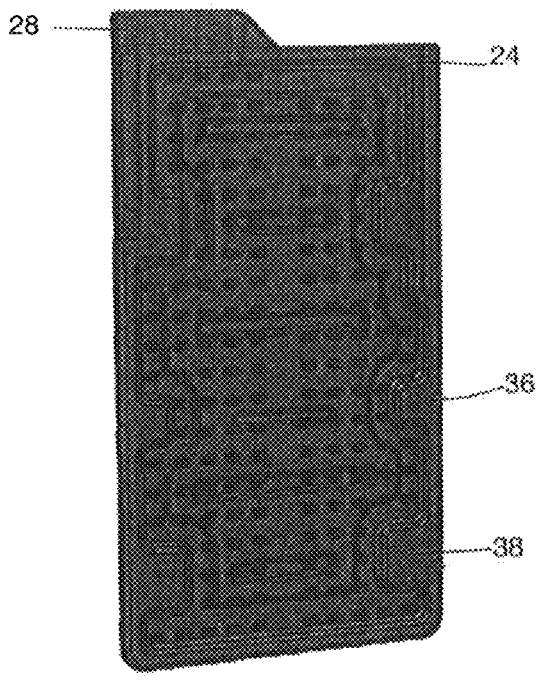
FIG. 4*b* is a perspective illustration of the back surface of the panel subunit of FIG. 4*a;*

As seen in FIGS. 4*a* and 4*b*, the panel subunit optionally has a substantially flat and generally planar elongate shape that is marginally continuous within three edges located adjacent to each other, and establishes the panel subunit's coupling edge with provided flanges 28 for overlap. In one non-limiting embodiment, the material of panel subunit 20 is blow-molded polyethylene with threaded inserts; however, this is not required. As can be appreciated, the panel subunit can be formed of other or additional materials.

Panel subunit 20 has a general rectangular shape. That is, two adjacent sides are greater in length than the other two adjacent sides; however, this is not required. In one non-limiting embodiment, the dimensions of a panel subunit are about 89.5" in length by about 48" in width and about 2.5" in depth. However, it can be appreciated that the panel subunit can have many other types of shapes and dimensions.

Figure 8:
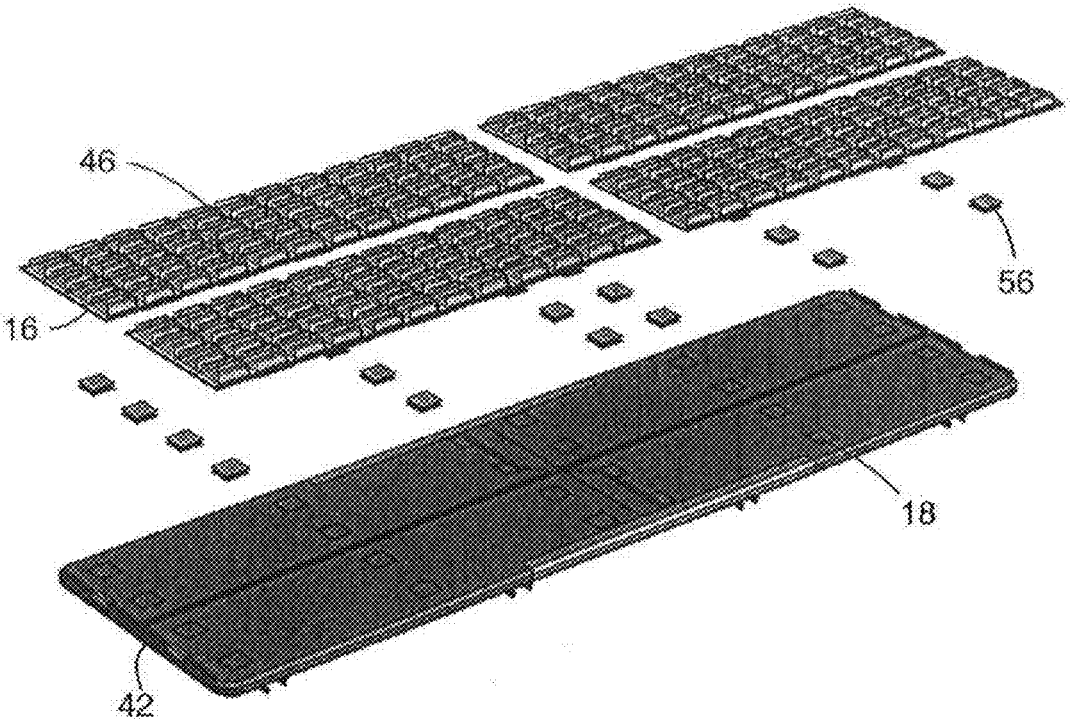
FIG. 8 is an exploded view perspective illustration of the means of attachment between the baffle and panel according to another non-limiting aspect of the present invention.

The flanges for overlap 28 are provided such that two identical panel subunits can be optionally coupled together to form one panel unit (as best seen in FIG. 8). When in a fully engaged position (that is, the overlapping portions 28 of the two identical panel subunits are fully engaged), the edge recessed zones 30 align for optional attachment of brackets (e.g., metal brackets, composite brackets, etc.) for the purpose of holding the two panel subunits together.

As best seen in FIG. 4*a*, the front surface 22 of panel subunit 20 optionally provides a recessed zone 30 on the left and right edges for attachment for side brackets. A plurality of impressed 4" by 4" squares (one of which is labeled as 18) are provided on the front surface 22 of panel subunit 20 tor optional 3M™ Dual Lock or similar material to be adhered to panel front surface 22.

Located between the left edge and right edge of panel unit 20, there is optionally provided a substantially square channel 34 for LED wiring. In one non-limiting embodiment, channel 34 is provided parallel to the left and right edges in a position equidistant from the left edge and right edge, and extends the full length of the panel subunit; however, it can be appreciated that other distances can be used. In embodiments. When two panel subunits are coupled at their coupling edge (forming one panel unit), channel 34 is continuous across both panels; however this is not required.

Referring now to FIG. 4*b*, the back surface 24 of panel unit 20 can optionally provide kiss-offs and varying grooves to provide strength and structure to the otherwise flat form of the panel subunit; however, this is not required.

Located at or near the left and right side edges of panel unit 20 are one or more optional flat zones where a pull-down latch or latching hook is fastened (one of which is labeled 36). Also located at or near the left and right side edges of panel unit 20 are one or more optional flat zones where PBU clips can optionally be fastened (one of this is labeled as 38). As can be appreciated, the location and quantity of flat zones 36 and 38 on the back surface 24 of panel subunit 20 can be varied.

Figure 5:
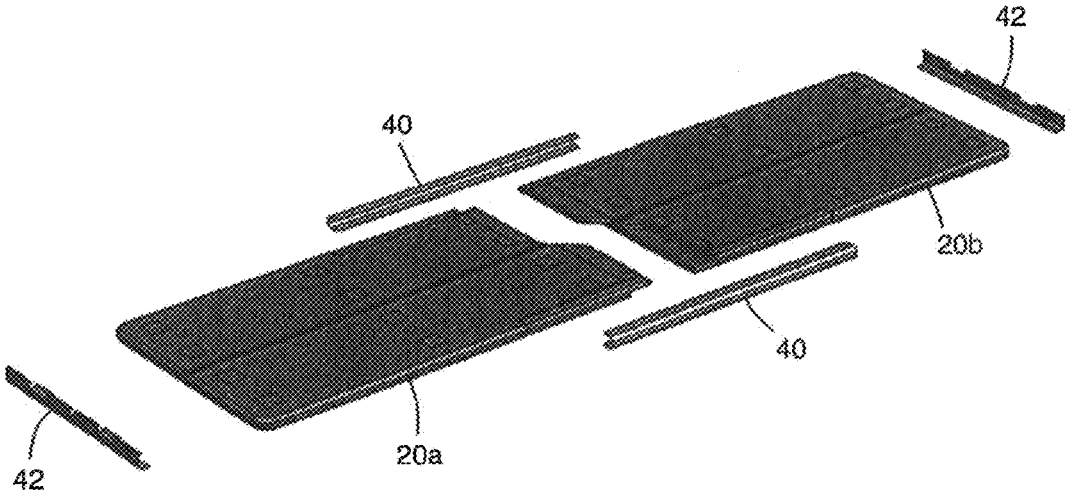
FIG. 5 is a perspective illustration of the brackets and panel subunits used to assemble the panel units according to one non-limiting aspect of the present invention.

As seen in FIG. 5, two optionally identical blow-molded panels 20*a* and 20*b* can be assembled with one or more side brackets 40 to provide a single panel. In non-limiting embodiments, the provided panel is about 14' in length and about 4' in width; however, this is not required. In one non-limiting embodiment, the material of side bracket 40 is aluminum; however, this is not required. As can be appreciated, the side bracket can be formed of other or additional materials.

Located at the distal end of each panel 20*a* and 20*b*, there is optionally attached a top-bottom bracket 42 for attachment to the panel, thus preventing the baffles (not shown) from sliding off the LED light boards (not shown). In one non-limiting embodiment, the material of top-bottom bracket 42 is aluminum; however, this is not required. As can be appreciated, the top-bottom bracket can be formed of other or additional materials.

Figure 6:
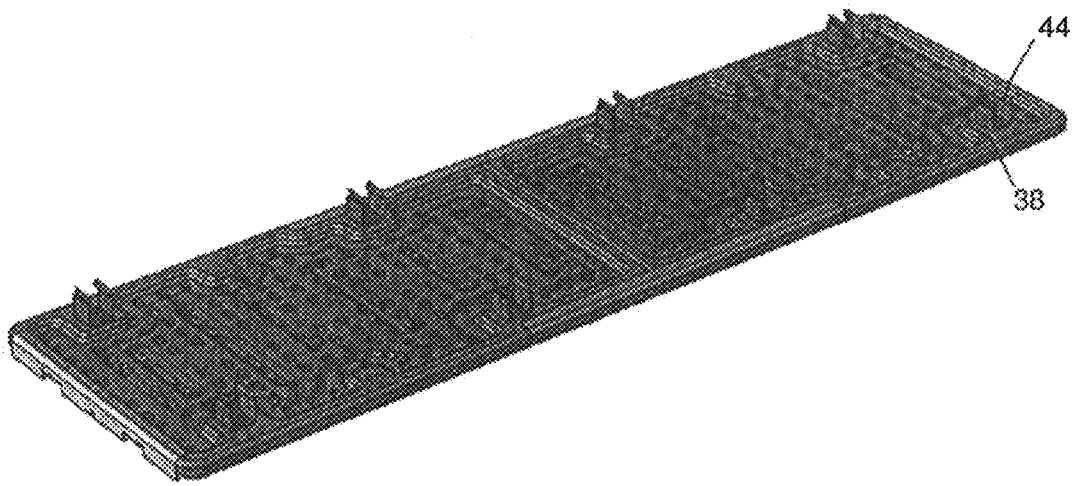
FIG. 6 is a perspective illustration of the back surface of an assembled panel unit according to another non-limiting aspect of the present invention.

FIG. 6 is a perspective illustration of the back surface of a partly assembled panel unit according to one non-limiting aspect of the present invention. Optionally mounted to the plurality of flat zones 38 are PBU clips 44 which clip onto the preexisting billboard's structural crossbars; however, other or additional means of attachment can be used. In one non-limiting embodiment, the material of PBU clips 44 is galvanized metal; however, this is not required. As can be appreciated, the PBU clips can be formed of other or additional materials.

In another or alternative non-limiting embodiment, the PBU clips can optionally be substituted with slide bars or arm members (e.g., telescoping, etc.) that can be adjusted to provide a relatively infinite adjustable arrangement to angle the assembled panel units in any direction; however, this is not required. As such, the billboard display can optionally be tilted downward at any one of a variety of angles to provide better visibility to groundlevel observers. As can be appreciated, individual panels can be tilted at different angles relative to one another; however, this is not required.

In another or alternative non-limiting embodiment, the orientation of the assembled panel units can be positioned such that the light generated by the LEDs are generally directed away from traffic approaching the billboard, thereby reducing bright spots and glare to viewers approaching the billboard; however, this is not required.

Figure 7:
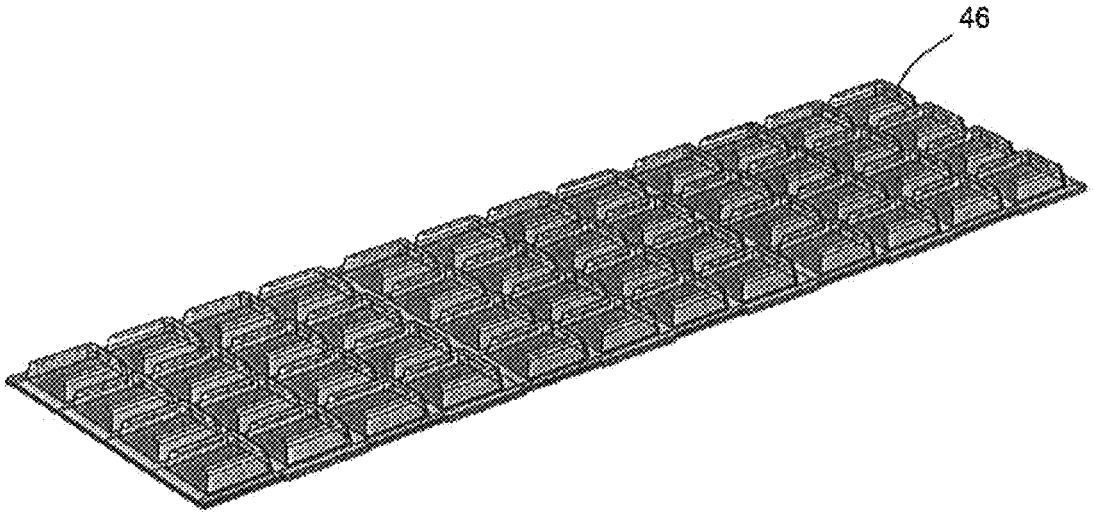
FIG. 7 is a perspective illustration of a baffle used in the LED billboard system according to another non-limiting aspect of the present invention.

As seen in FIG. 7, one non-limiting embodiment of the present invention provides a baffle 46 mounted to the front surface 22 of panel unit 20. The baffle, as seen in FIG. 7, protects the underlying LED panels (not shown) from getting scratched by the optional overlaying graphic wrap (not shown). The baffles are optionally clear such that light may penetrate through the baffle to the graphic wrap; however, this is not required. The baffles are optionally open on one or more sides allowing moisture to pass through the whole system; however, this is not required. As such, the unique structure of the baffle according to one aspect of the present invention permits the LED light boards to endure outdoor conditions.

In one non-limiting embodiment, the material of baffle 46 is injection molded acrylic; however, this is not required. As can be appreciated, the baffle can be formed of other or additional materials.

The overall dimensions of one non-limiting baffle are about 28" in length by about 24" in width and about 2" in depth. However, it can be appreciated that the baffle can have other dimensions. The unique structure and thickness of the baffle optionally permits air and moisture to pass through the system, but limits the amount of air passing through the baffle such that the overlaying graphic wrap is not blown away by wind, for example; however, this is not required.

In one non-limiting embodiment of the present invention, an LED light board is not required. Instead, LED light strips can be directly mounted to the baffle. The crest/valley structure of the baffle is designed to provide sufficient mechanical strength and sturdiness for the mounting operations. The LED light strips can be mounted in the valley portion of the baffle; however, this is not required. The height of the crest of the baffle can be designed such that the overlaying cover is illuminated uniformly.

In another non-limiting embodiment of the present invention, the LED light strips can be mounted on the back side of the baffle with the LEDs emitting through the baffle (i.e., between two valleys underneath a crest). As such, the illumination effect can be further modified with various spacer structures, materials, transparency, translucency, color, surface features, etc.

As seen in the non-limiting perspective illustration of FIG. 8, four light boards 16 and their baffles 46 are optionally attached to the partly assembled panels using pieces of 3M™ Dual Lock 56 or some other material. As can be appreciated, other means of attachment can be used.

Each 4"×4" square of 3M™ Dual Lock attached to square 18 on panel subunit 20 receives a 4"×4" 3M™ Dual Lock square on the back surface of the light boards. As such, when the light board is engaged with the panel, the securing of the 3M™ Dual Lock and top-bottom brackets assists in preventing up or down, side-to-side, or rotational movement of the light board relative to the panel.

In one non-limiting embodiment, one or more light dispersing components may optionally be used between any layers of the assembled panel unit for the purpose of optionally absorbing, reflecting, or refracting light from the lighting source; however, this is not required.

One non-limiting advantage of the lighting system of the present invention is that in the event an LED light board fails or the bulbs go out, the LED light board can be easily and conveniently replaced via separation of the 3M™ Dual Lock.

Figure 9:
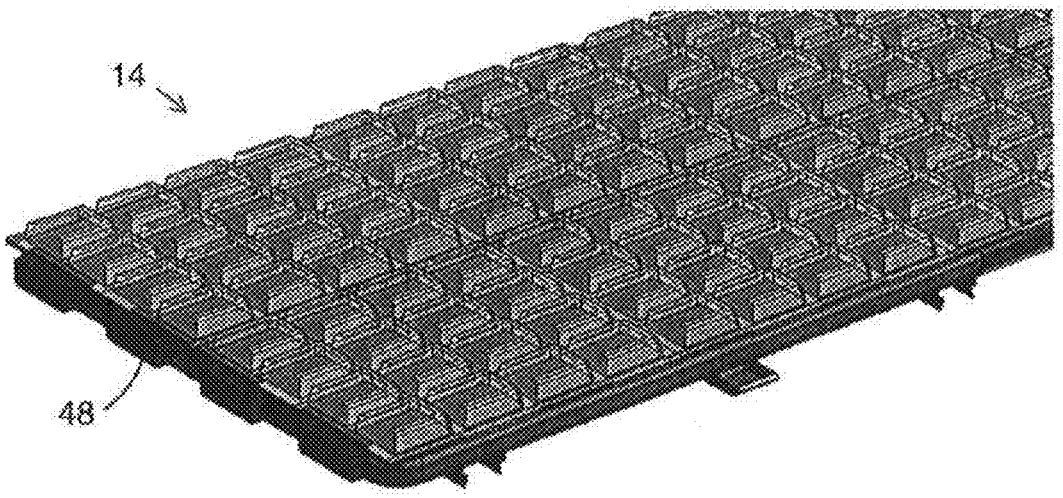
FIG. 9 is a perspective illustration of a fully assembled panel unit illustrating the transformers mounted to the LED billboard system according to another non-limiting aspect of the present invention.

As seen in FIG. 9, a perspective illustration of fully assembled panel unit 14, one or more transformers 48 can be used; however, this is not required. In one non-limiting embodiment, the one or more transformers 48 can optionally be 24 Volt transformers; however, this is not required. As can be appreciated, other types of transformers can be used. In another or alternative non-limiting embodiment, solar photovoltaic panels can optionally be used to absorb solar energy and further convert the solar energy into electrical energy to provide electricity to the LED billboard system.

In one non-limiting embodiment, each LED light board requires its own 24 Volt transformer; however, this is not required. As such, four transformers are optionally mounted to the top-bottom bracket 42 of the assembled LED billboard system unit.

Figure 10:
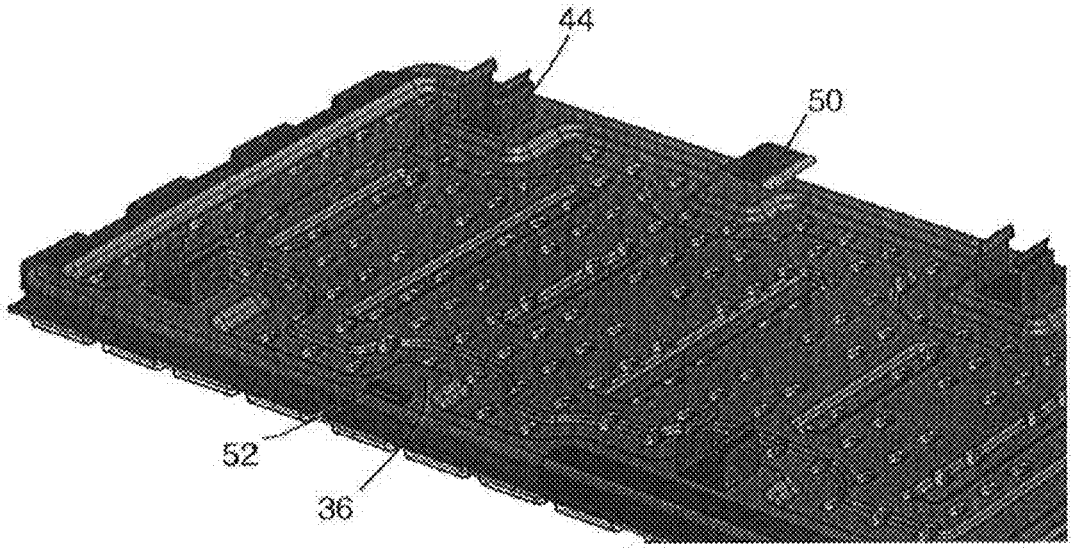
FIG. 10 is a perspective illustration of the back surface of an assembled LED panel illustrating latches used to secure neighboring panels together according to another non-limiting aspect of the present invention.

Referring now to FIG. 10, each panel unit 20 is provided with one or more flat zones 36 for fastening of pull-down latches 50 or fastening of latching hooks 52. The pull-down buckle latch 50 and latching hook 52 are optionally mounted to the backside of the assembled panel unit. In one non-limiting embodiment, the material of latching hooks 50 is metal (e.g., galvanized metal, plastic, etc.); however, this is not required. As can be appreciated, the latching hooks can be formed of other or additional materials. The buckle system permits neighboring panels to clasp each other and hold securely and firmly side-by-side. Put another way, the buckle system keeps neighboring panels from separating; however, this is not required.

Figure 11:
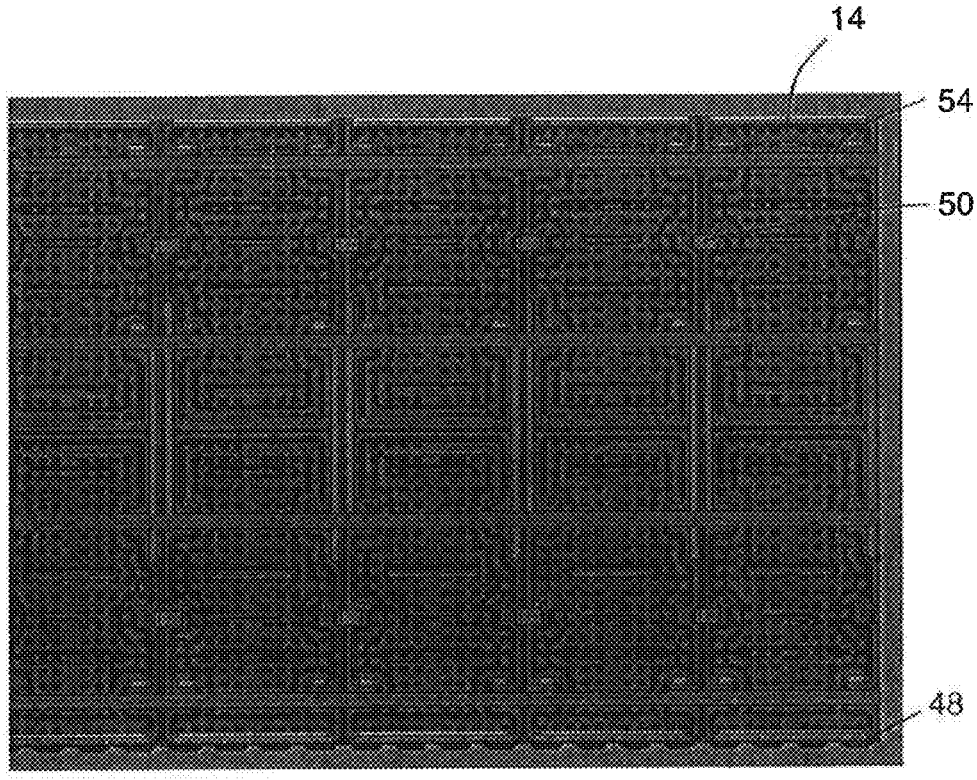
FIG. 11 is a perspective illustration of the back side of a fully assembled LED billboard system according to another non-limiting aspect of the present invention.

As seen in FIG. 11, the fully assembled panel units are hung on the billboard's structural crossbars, one of which is marked as 54, and clasped together, side-by-side, with one or more pull-down buckle latches 50.

The LED transformers 48 are optionally strung together toward the bottom of the billboard; however, this is not required.

In use, the assembled panel units are optionally hung on a pre-existing billboard's structural crossbars and a graphic wrap is optionally stretched across the partial or entire face of the billboard. When the LED panels are switched on, the billboard can be illuminated from behind.

In one non-limiting embodiment, a light sensor module can be used to control switching the LED panels on and/or off; however, this is not required. In another or alternative non-limiting embodiment, a clock-controlled module can be used to control switching the LED panels on and/or off; however, this is not required. The light sensor can also optionally be used to control brightness, color, wavelength, etc. of the one or more LED lights on a panel and/or the lights on various panels.

Traditional spotlight lighting systems on billboards provide substantially uneven light distribution across the front face of a billboard. One non-limiting advantage of the LED billboard system of the present invention is that the LED light boards used in the present invention can provide a substantially even light distribution across the partial or entire face of the billboard, or customized light distribution on various regions of the billboard; however, this is not required.

To accommodate various orientations and locations of pre-existing and future billboards, the LED billboard system, according to one non-limiting aspect of the present invention, can be provided in which the orientation/angle of the billboard, distance from the billboard to intended viewer, brightness, and positioning of additional lighting fixtures (e.g., street lights, parking lot lights, etc.) can be compensated for by adjusting the LED lighting system; however, this is not required. In this regard, different intensities of light may be required on different portions of the billboard. As such, the light panels of the LED billboard system of the present invention can be controlled individually and be optionally adjusted such that the billboard is illuminated differently at various points across its surface; however, this is not required.

Figure 12:
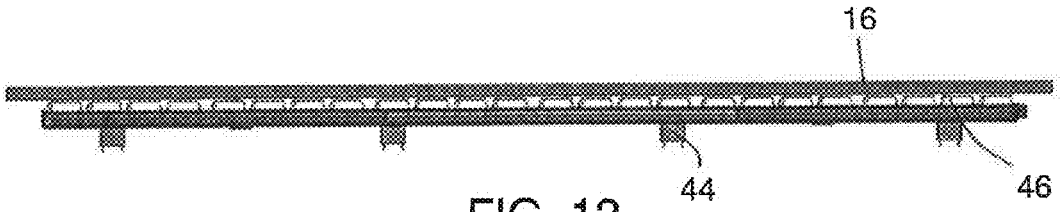
FIG. 12 is a top perspective view of the LED billboard system according to one non-limiting aspect of the present invention.

FIG. 12 illustrates a top-down perspective illustration according to one non-limiting embodiment of the present invention. In use, baffle 46 provides a buffer zone between light boards and overlaying cover graphic wrap 16; however, this is not required. Optionally, PBU clips 44 are provided on the back surface of the panel units for engaging with a billboard's structural crossbars.

Figure 13:
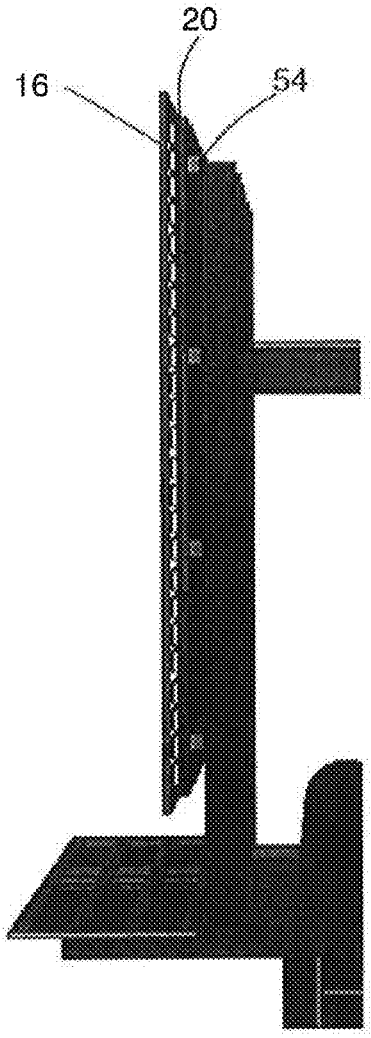
FIG. 13 is a side perspective view of another non-limiting LED billboard system in use attached to the front face of a pre-existing billboard structure.

Referring now to FIG. 13, a side-view perspective illustration according to another non-limiting embodiment of the present invention, structural crossbars 54 engage with PBU clips 44 to hold the LED billboard system 10 in place on the billboard structural crossbars 54.

Generally, the unique structure of LED billboard system 10 permits easy and convenient attachment or retrofitting to pre-existing billboard structures for illuminating billboard graphics as needed during low visibility conditions (e.g., at dusk, during nighttime hours, etc.).

The LED billboard system of the present invention can be modified to be implemented onto most pre-existing and future billboard structures. A typical billboard structure comprises a welded steel frame wherein panels are hung on the front side crossbars of the steel billboard structure that are generally comprised of steel and wood to provide a substantially flat shape for an overlaying graphic wrap to be displayed. However, the manufacturing costs of current billboard panels are high and the materials with which the panels are made are very heavy. The optional blow-molded polyethylene material of the panel subunits and optional aluminum material of the brackets of the LED billboard system, according to one aspect of the present invention, make the assembled panel units of the present invention considerably less expensive and dramatically lighter in weight.

In non-limiting embodiments, the assembled panel unit of the present invention is designed to provide support for optional LED light boards and baffles to protect them; however, this is not required. As can be appreciated, other or alternative types of light boards can be used.

The unique structure of the LED billboard system of the present invention permits quick and easy on-site assembly at any location where the LED billboard system is to be used. The parts and components of the LED billboard system can be optionally packed into boxes and transported to the site of installation where a crew of workers can assemble the panel units prior to installation; however, this is not required. As can be appreciated, the LED billboard system can be pre-assembled.

In one non-limiting method of installation, two identical blow-molded panels can be fastened together using side brackets. Top-bottom brackets and clips can be fastened to the panels. 3M™ Dual Lock or similar material can be used to secure four LED light boards onto each assembled panel unit. Eight baffles can be used to attach onto the four LED light boards. The twelve fully assembled panel units can be hoisted to the billboard structure and can be attached to the pre-existing billboard structure. Pull-down buckle latches can be used to secure neighboring panels side-by-side. A graphic wrap can be hung across the partial or entire face of the billboard such that when the LED light boards are switched on, the billboard can be illuminated from behind. As can be appreciated, other or additional quantities of components and methods of installation can be used.

Optional or additional installation steps can include grounding of LED electrical components, etc.

Referring now to another non-limiting embodiment of the invention as illustrated in FIGS. 14-35, an LED billboard system optionally comprises panel subunits; LED carpets, one or more edge baffles, one or more center baffles, and a graphic wrap; however, this is not required. Generally, with reference to FIG. 35, the assembled LED billboard system can be attached to or retrofitted to fit pre-existing billboard structures for the purpose of illuminating the billboard display as needed or required, usually in low visibility conditions (e.g., during dusk, nighttime hours, etc.).

Figure 14:
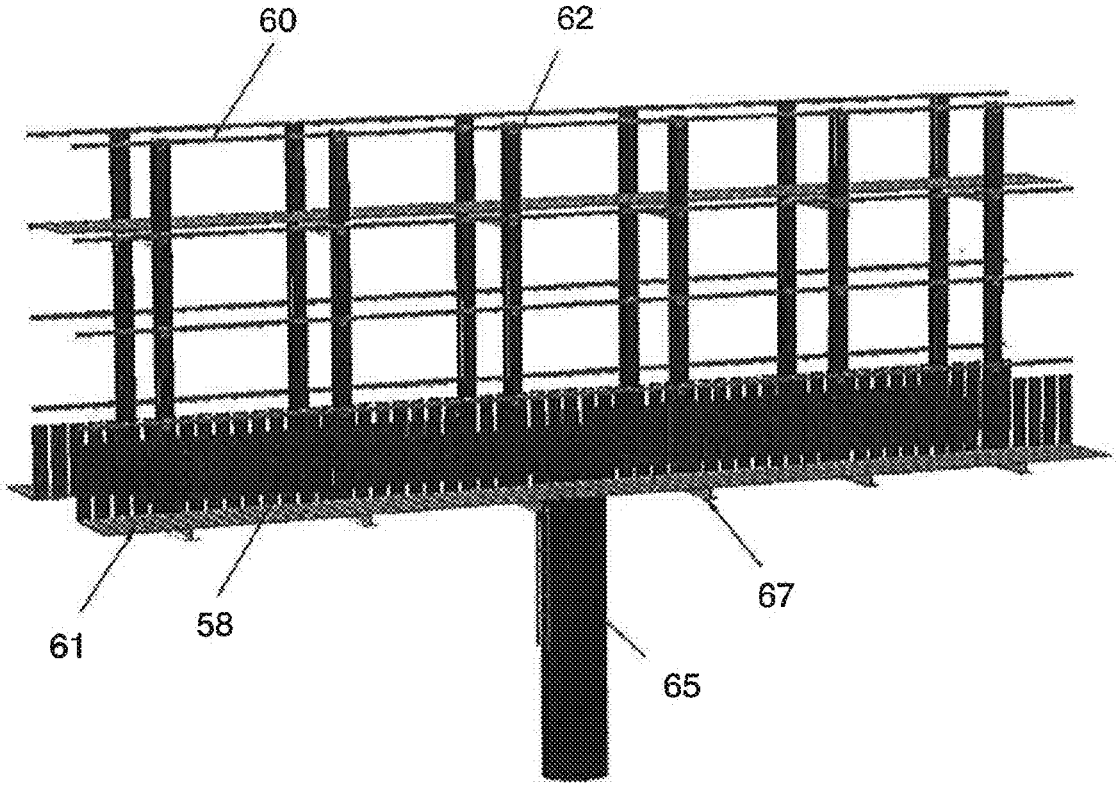
FIG. 14 is a perspective illustration of a general billboard structure according to another non-limiting aspect of the present invention.

FIG. 14 is a perspective illustration of a general billboard structure wherein one or more stringers 60 can be attached to billboard structural uprights, one of which is marked as 62. Generally, uprights 62 are metal I-beams in a substantially vertical orientation; however, other or additional materials can be used. In use, stringers 60 can engage a PBU clip provided on the back surface of a panel unit; however, this is not required. As such, the stringer system can support the panel units as they are optionally hung on the billboard structure.

Traditional billboard structures can also comprise outriggers 57, steel I-beams running perpendicular to the torsion bar, and a skirting 58 running parallel to the stringer 60 or catwalk 61.

The material of stringer 60 can be angle metal; however, this is not required. As can be appreciated, other or alternative materials can be used. The stringer dimensions can be 3" in height by 3" in width; however, this is not required. As can be appreciated, other or alternative sizes can be used. In non-limiting embodiments, one stringer unit can consist of one or more 3" by 3" pieces.

In non-limiting embodiments, stringer 60 can be welded, bonded, riveted, etc. perpendicularly to the upright masts 62 of the billboard skeleton; however, this is not required. Traditional billboard structures can comprise structural crossbars running perpendicular to the upright masts. In other non-limiting embodiments, stringer 60 can be attached to the structural crossbars directly; however, this is not required.

In another non-limiting embodiment, stringers 60 can be welded, bonded, riveted, etc. substantially parallel to catwalk 61; however, this is not required. As can be appreciated, the one or more stringers can be oriented in any direction such that stringer 60 can accept and engage the PBU clip mounted to the back surface of a panel unit. The distance between the one or more stringers can be equal; however, this is not required. As can be appreciated, the spacing between parallel stringers can be unequal.

Figure 15A:
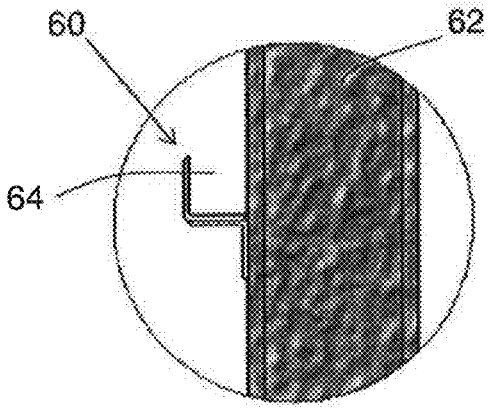
FIG. 15*a* is a zoomed-in perspective illustration of area "A" in FIG. 15*b;*
Figure 15B:
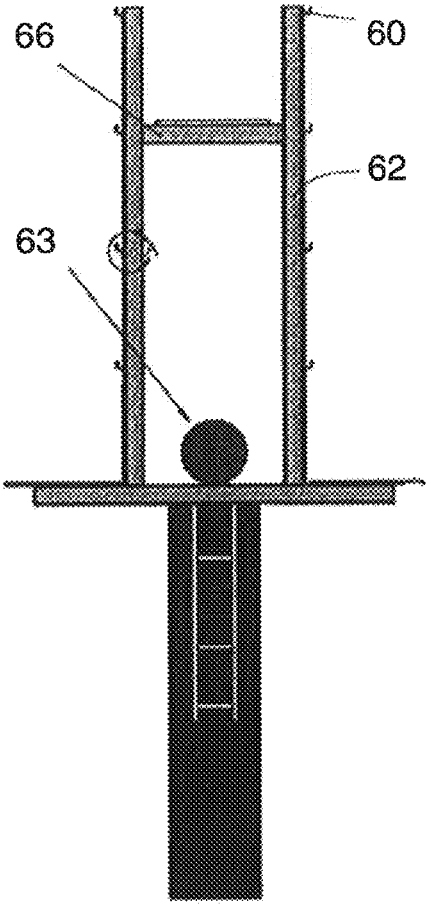
FIG. 15*b* is a side-view perspective illustration of a billboard structure according to another non-limiting aspect of the present invention.

FIG. 15*a* is a zoomed-in, perspective illustration of area "A" in FIG. 15*b*. As seen in the side-view perspective illustration of FIG. 15*a*, the stringer unit 60 can extend outward away from the upright mast 62, thereby creating a substantially U-shaped channel 64 to optionally receive part of a PBU clip attached to the back surface of a panel; however, this is not required.

FIG. 15*b* is a side-view perspective illustration according to another non-limiting embodiment of the present invention. Generally, a traditional billboard structure can include a torsion bar 63, a substantially horizontal tube that mounts perpendicular to the column 65, and outriggers 66, steel I-beams running perpendicularly to the torsion bar 63. Stringers 60 can be mounted to the front surfaces of upright mast 62; however, this is not required.

Figure 16:
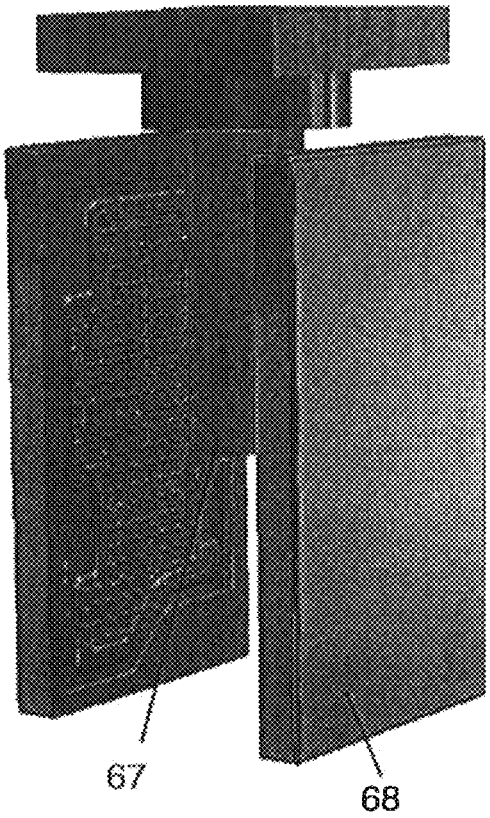
FIG. 16 is a perspective illustration of a blow molding machine used in one non-limiting aspect of the present invention.

As seen in FIG. 16, a blow molding machine can be used to manufacture the billboard panels of the present invention; however, this is not required. As can be appreciated, other means of manufacturing can be used. According to one non-limiting aspect of the present invention, the LED billboard panels can be formed by extrusion blow molding; however, this is not required. As can be appreciated, other types of blow molding processes can be used (e.g., injection blow molding, injection stretch blow molding, casting, etc.).

Generally, the blow molding process includes the formation of a plastic parison 67, which can be clamped into a two-part mold apparatus 68 into which air can be blown. As air pressure rises inside the parison, the plastic is pushed out to match the mold. Once the plastic is cooled, the mold releases the plastic and the blow-molded component is released. As can be appreciated, other or alternative methods of blow molding can be used.

The LED billboard panels of the present invention can be manufactured by a plastic component manufacturer; however, this is not required.

Optional PBU clips can come pre-assembled to the blow-molded panels in their designated orientation; however, this is not required.

Figure 17:
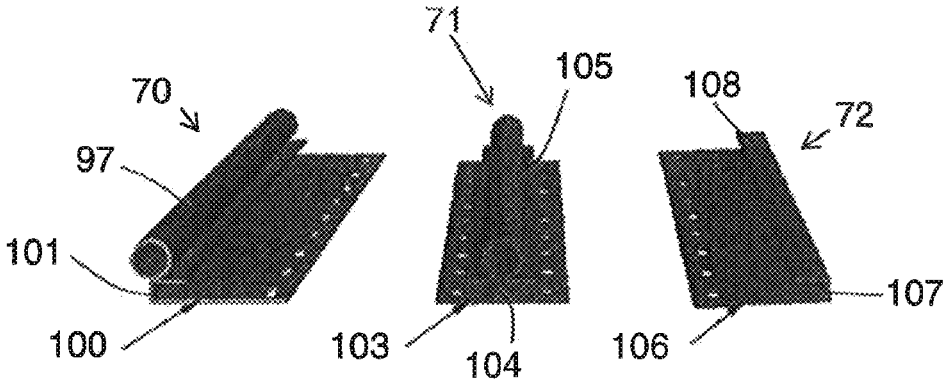
FIG. 17 is a perspective illustration of the baffle system according to another non-limiting aspect of the present invention.

FIG. 17 illustrates one or more baffle extrusions that can be used in one non-limiting arrangement of the present invention. The material of the one or more baffle extrusions can be injection molded acrylic; however, this is not required. As can be appreciated, the baffle can be formed of other or additional materials.

In one non-limiting embodiment of the present invention, three clear acrylic baffle extrusions are provided, marked here as 70, 71, and 72; however, this is not required. Baffle extrusions can optionally include a hollow tube 97 along the top surface of the baffle extrusion. The tubes on top of the baffle extrusions serve to separate, lift, or give distance between the LED panel and the graphic wrap. This distance (e.g., approximately 1-6 inches, 3 inches, etc.), is used to provide air space for light to diffuse before penetrating the translucent graphic wrap. In use, a small gap can exist between neighboring LED panels which are not illuminated, and can appear as a dark line on the illuminated billboard. Thus, the tubes also can optionally serve to diffuse light across the shadow gap between two adjacent LED panels. Any edge that intersects with the back of the printed sign panel will show up as a shadow except a tube that diffuses the light from below and has no hard upper edge.

Baffle extrusion 70 can optionally comprise a bottom plate 100, continuously connected with a vertical plate 101 extending perpendicularly from one edge of bottom plate 100, and further continuously connected with a third plate 102 parallel to the bottom plate 100 that extends partially over bottom plate 100, wherein a channel is created between the bottom plate 100, vertical plate 101, and parallel plate 102. Optionally provided on bottom plate 100 are holes through which the baffle extrusion can be mounted to a surface of a panel (e.g., blow molded panel, etc,).

Baffle extrusion center piece 71 can contain a bottom plate 103, continuously connected with a vertical plate 104 extending perpendicularly therefrom from a midline of bottom plate 103, and further continuously connected with a third plate 105 parallel to the bottom plate 103 that extends partially over bottom plate 103. As such, channels are created between bottom plate 103 and top parallel plate 105 on one or both sides of vertical plate 104. Optionally provided on bottom plate 103 are holes through which the baffle extrusion can be bolted to a surface of a blow-molded panel.

Baffle extrusion 72 can comprise a bottom plate 106, continuously connected with a vertical plate 107 extending perpendicularly from one edge of bottom plate 106, and further continuously connected with a third plate 108 parallel to the bottom plate 106 that extends partially over bottom plate 106, wherein a channel is created between the bottom plate 106, vertical plate 107, and parallel plate 108. Optionally provided on bottom plate 106 are holes through which the baffle extrusion can be mounted to a surface of a blow-molded panel.

The width of the channel in baffle extrusions 71, 71, and 72 can be the same; however, this is not required. As can be appreciated, the thickness of the channels created can be easily controlled during manufacturing to accommodate different dimensions of light boards and other like lighting systems.

Figure 18A:
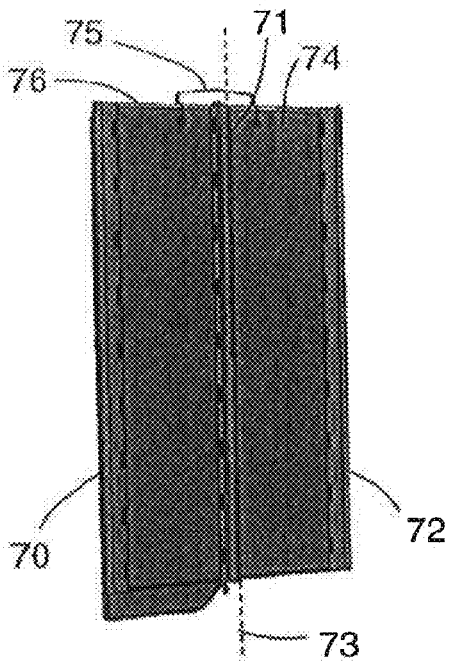
FIG. 18*a* is a perspective illustration of the front surface of a partially assembled panel subunit according to another non-limiting aspect of the present invention.
Figure 18B:
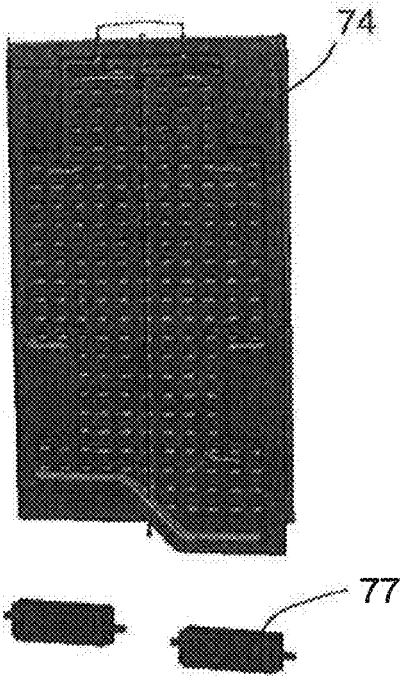
FIG. 18*b* is a perspective illustration of the back surface of a partially assembled panel subunit according to another non-limiting aspect of the present invention.

FIGS. 18*a* and 18*b* are perspective illustrations of the front surface and back surface, respectively, of a partially assembled panel subunit according to one non-limiting aspect of the present invention.

Referring now to FIG. 18*a*, baffle extrusion 70 can be mounted to one side edge of a panel, baffle extrusion 72 can be mounted to the side edge opposite baffle extrusion 70, and baffle extrusion 71 can be mounted parallel to baffle extrusion 70 and baffle extrusion 72 along the longitudinal midline 73 of panel subunit 74; however, this is not required. As can be appreciated, other baffle orientations can be used.

The optional holes provided on baffle extrusions 70, 71, and 72 provide a means to secure the baffle extrusions to the front surface of panel subunit 74. In one non-limiting embodiment, bolts are used to secure the baffles to the panel subunit; however, this is not required. As can be appreciated, other means of attachment can be used.

Optionally disposed at or near the top edge 76 of panel unit 74 are hanging cables 75 for use in installation. As such, the hanging cables can be secured to the panel such that a crane can lift the panel unit by the hanging cable and hoist the panels up to the billboard structure; however, this is not required.

Referring now to FIG. 18*b*, the back surface of panel subunit 74 of FIG. 18*a* is provided. As illustrated, one or more transformers 77 can be secured to the blow molded panel; however, this is not required.

Figure 19:
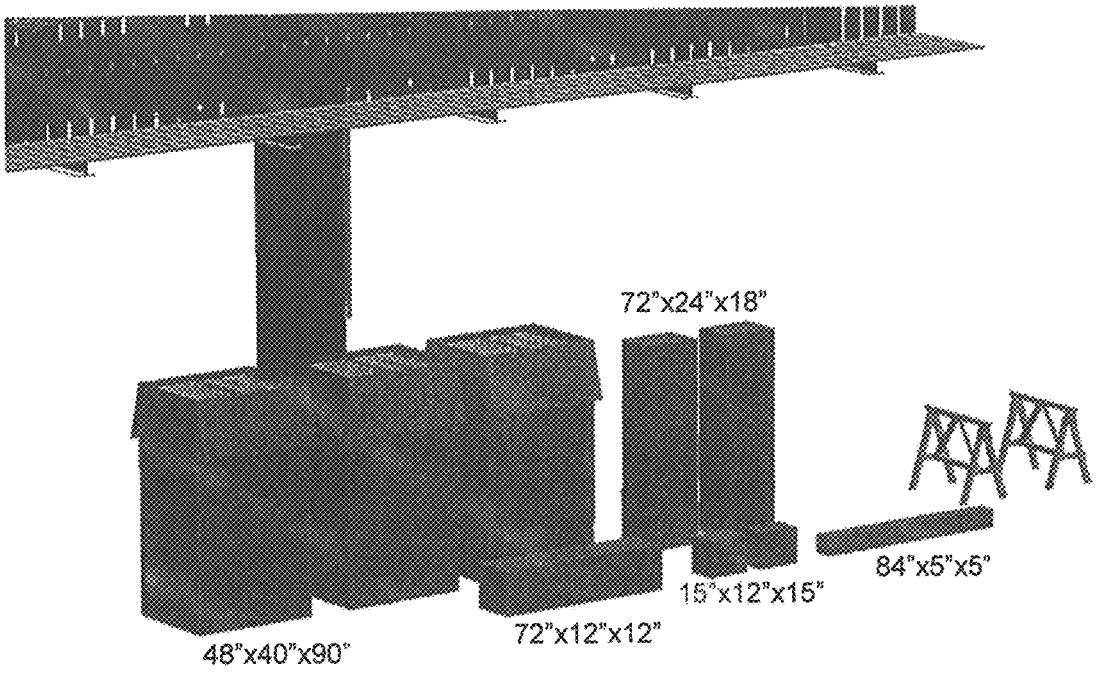
FIG. 19 is a perspective illustration demonstrating optional on-site assembly according to another non-limiting aspect of the present invention.

FIG. 19 illustrates one non-limiting embodiment of the present invention wherein the LED billboard system can permit on-site assembly. According to one non-limiting aspect of the present invention, the LED billboard components can be shipped in packages and require further on-site assembly; however, this is not required. At the site of installation, two identical panels can be fastened together, thereby providing a 14' by 4' super structure as seen in FIG. 20.

With continued reference to FIG. 19, in one non-limiting example of packaging for installation, the panel units can be packaged in three 48" by 40" by 90" packages, the LED light boards can be packaged into two 72" by 24" by 18" packages, the side brackets can be packaged into one 72" by 12" by 12" package, PBU clips can be packaged in two 18" by 12" by 15" packages, and extra tube baffles can be packaged in one or more 84" by 8" by 8" packages; however, this is not required. As can be appreciated, more or less packaging can be used and other or additional size packaging can be used.

Figure 20A:
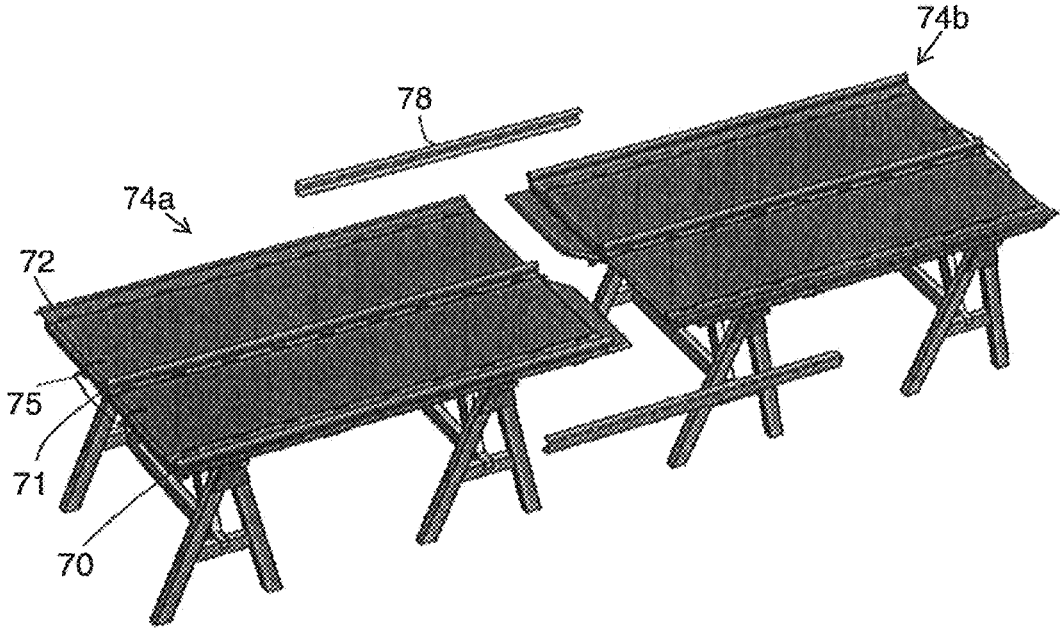
FIG. 20*a* is a perspective illustration of two panel subunits assembled to provide one single panel unit according to another non-limiting aspect of the present invention.

Referring now to FIG. 20*a*, two identical panel subunits, marked as 74*a* and 74*b*, can be assembled with one or more side brackets 78 to provide one single panel unit. The brackets are positioned under the baffle extrusions. Panels can have a designated region for the brackets to connect to each other. This region is recessed such that the brackets lay flush with the main surface of the panel.

In non-limiting embodiments, the provided panel unit is about 14' in length by about 4' in width; however, this is not required.

The material of side bracket 78 is metal; however, this is not required. As can be appreciated, the side bracket can be formed of other or alternative materials.

Figure 20B:
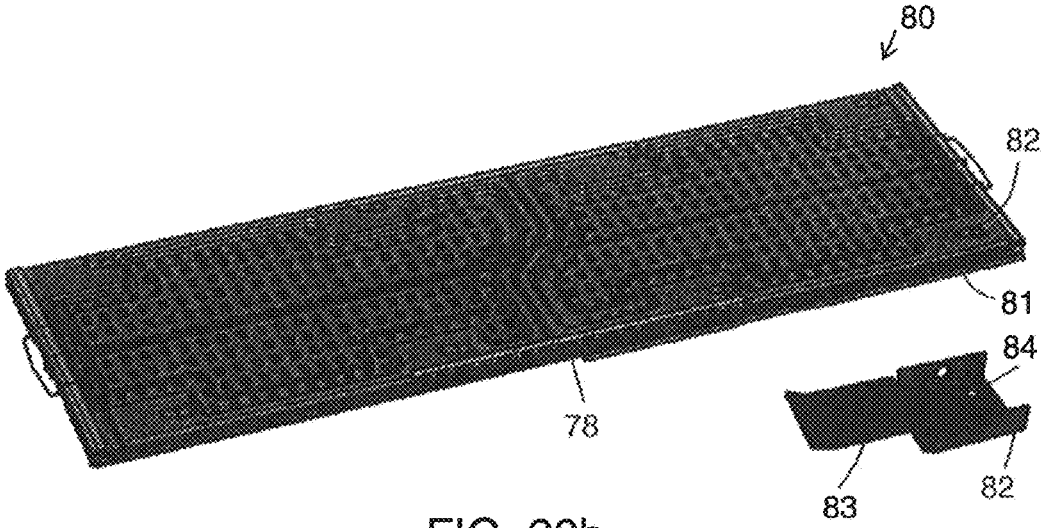
FIG. 20*b* is a perspective illustration of the back surface of the assembled panel unit of FIG. 20*a;*

FIG. 20*b* is a perspective illustration of the back surface of the assembled panel unit of FIG. 20*a*. Optionally mounted to one or more flat zones 81 provided on the back surface of assembled panel unit 80 are one or more PBU clips 82. PBU clips 82 can engage with stringer 60 such that the flange 83 of PBU clip 83 inserts into channel 64 provided by stringer 60. Holes provided on the body 84 of PBU clip 82 are provided for attachment by a bolt to the back surface of a panel unit or panel subunit.

In non-limiting embodiments, the material of PBU clip 82 is metal (e.g., galvanized metal); however, this is not required. As can be appreciated, the PBU clip can be formed of other or alternative materials.

In other non-limiting embodiments, the PBU clips can come pre-assembled to the panels in their designated orientation; however, this is not required. As such, holes on the body 84 of the engagement surface of PBU clip 82 are arranged such that the PBU clips can be screwed into threaded inserts in the panel; however, this is not required.

Figure 21:
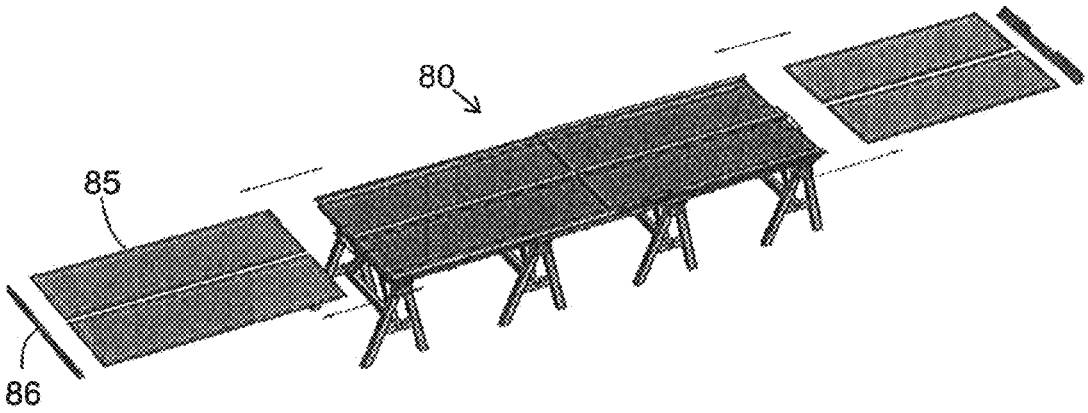
FIG. 21 is a perspective illustration demonstrating LED light boards in use in the LED billboard system according to one non-limiting aspect of the present invention.

FIG. 21 provides a perspective illustration demonstrating LED light boards sliding into the channels of baffles 70, 71, and 72. As seen in FIG. 21, LED light boards, one of which is marked as 85, can be slid into the channel created by the baffle. Top-bottom brackets 86 can then be attached to the open ends of the panel unit for the purpose of securing the light board within the extrusion channel such that the light boards are prevented from sliding out.

Baffles or spacers can be added to the channels for the purpose of limiting the vibration or shaking of the LED light board or LED carpet within the extrusion channel; however, this is not required. As can be appreciated, other methods can be used to minimize movement within the extrusion channel.

Each LED light board can have LEDs on two sides, thus permitting the light to project through the graphic wrap; however, this is not required. As can be appreciated, the LED light board can have LEDs on one surface. As such, the light is evenly distributed, except for the long edges, which are often brighter. By placing tubular extrusion baffles above the bright edges, light can be dispersed at an even flow.

Figure 22:
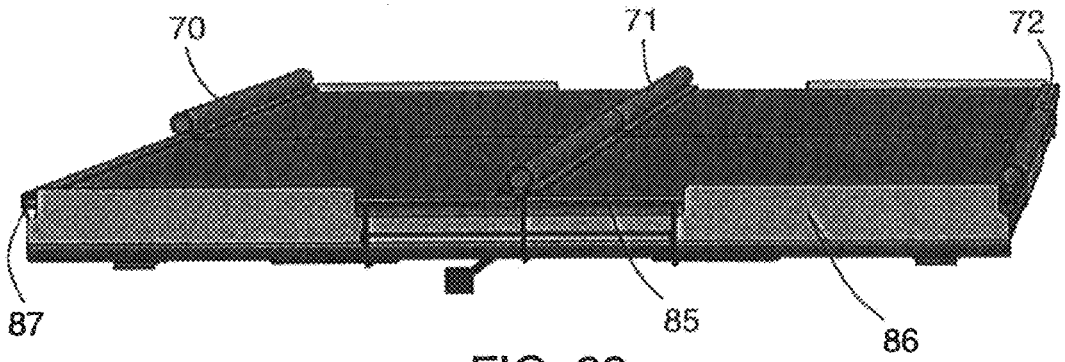
FIG. 22 is a perspective illustration of the assembled panel unit of FIG. 21 according to another non-limiting aspect of the present invention.

FIG. 22 is a perspective illustration of a fully completed panel unit 80 according to one non-limiting aspect of the present invention. As demonstrated in FIG. 22, LED light boards 85 are held in the channels on their longitudinal edges by baffles 70 and 71, or 71 and 72 and also at the distal ends by top-bottom brackets 86. As such, the LED light boards are held in place within the channels and are prevented from sliding out.

Figure 23:
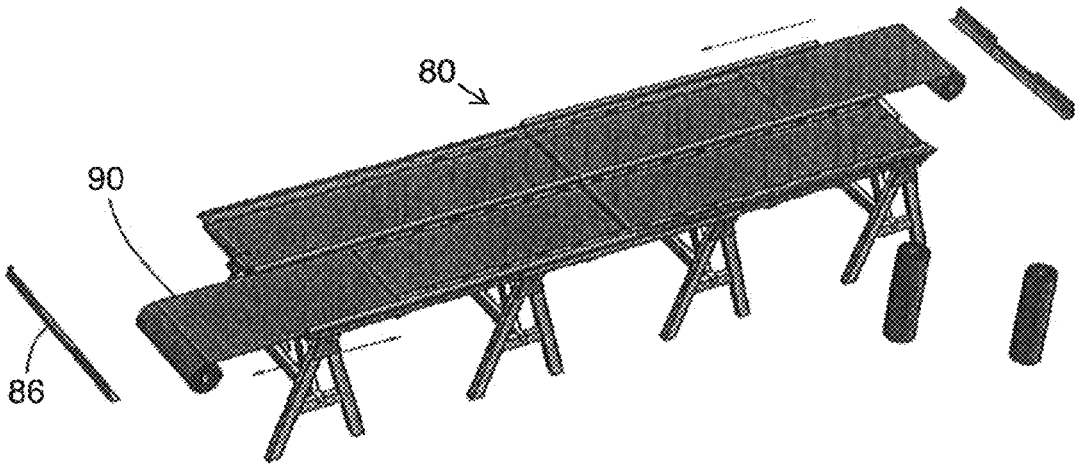
FIG. 23 is a perspective illustration demonstrating LED carpets in use in the LED billboard system according to another non-limiting aspect of the present invention.

FIG. 23 provides a perspective illustration demonstrating LED carpets, one of which is marked as 90, sliding into the channels created by baffles 70, 71, and 72. As seen in FIG. 23, LED carpets can be unrolled and slid into the channel created by the baffle. Top-bottom brackets 86 can then be attached to the open ends of the panel unit for the purpose of securing the LED carpet within the channel such that the LED carpet is prevented from sliding out. The LEI) carpet, having been inserted into the baffle channels, can be fastened on the top and bottom edges. They can be fastened with either mounting fasteners such as screws or tape, or clasp fasteners like a hook or clamp. The LED carpet, having been inserted into the baffle channels, and fastened on the top and bottom edges, will not slide, wrinkle, or slip in any way.

Figure 24:
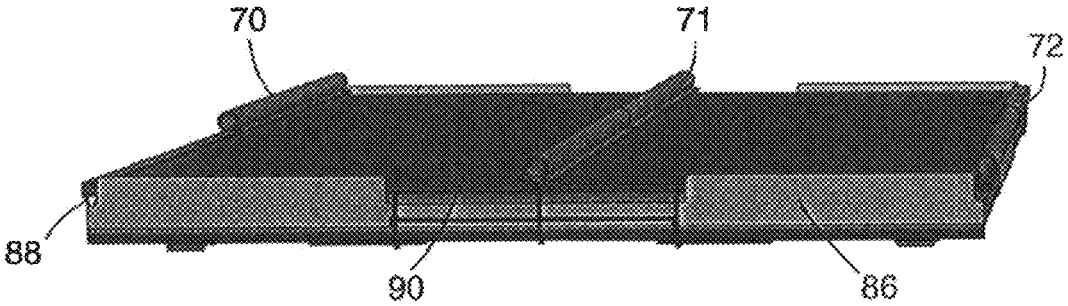
FIG. 24 is a perspective illustration of the assembled panel unit of FIG. 23.

FIG. 24 provides a perspective illustration of a fully completed panel unit 80 according to another non-limiting aspect of the present invention. As show in FIG. 24, LED carpets 90 are held in the channels on their longitudinal ends by baffles 70 and 71, or 71 and 72 and also at the distal ends by top-bottom brackets 86. As such, the LED carpets are held in place within the channels and are further prevented from sliding out.

Figure 25A:
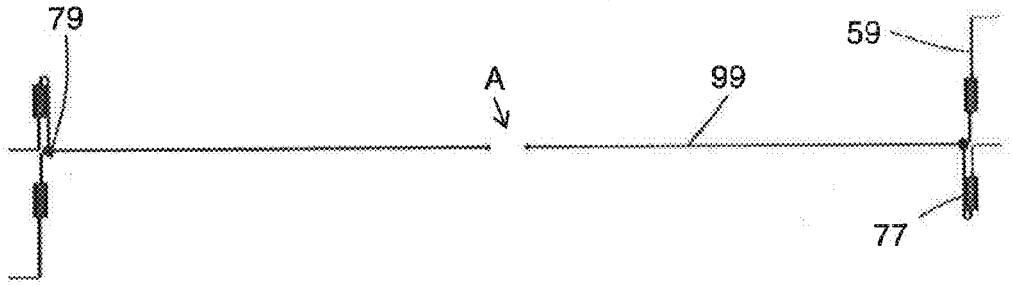
FIG. 25*a* is a wiring illustration according to another non-limiting aspect of the present invention.

FIG. 25*a* is an illustration showing the wiring diagram used in one non-limiting embodiment of the present invention. As seen in FIG. 25*a*, power can be split to two transformers, one of which is marked as 77, one for each LED panel; however, this is not required. As such, transformers 77 can convert 110V to 24V; however, this is not required. Other or alternative transformers can be used. A line 59 can extend from the transformer to supply the LED panel. The two panel subunits and two wiring systems can junction (e.g., via soldering, crimping, connectors, etc.), marked here as "A." As such, lines 99 can junction such that only one power source is necessary, however, this is not required. Power can be supplied by any external power source; however, this is not required. As can be appreciated, other or alternative power sources can be used.

Figure 25B:
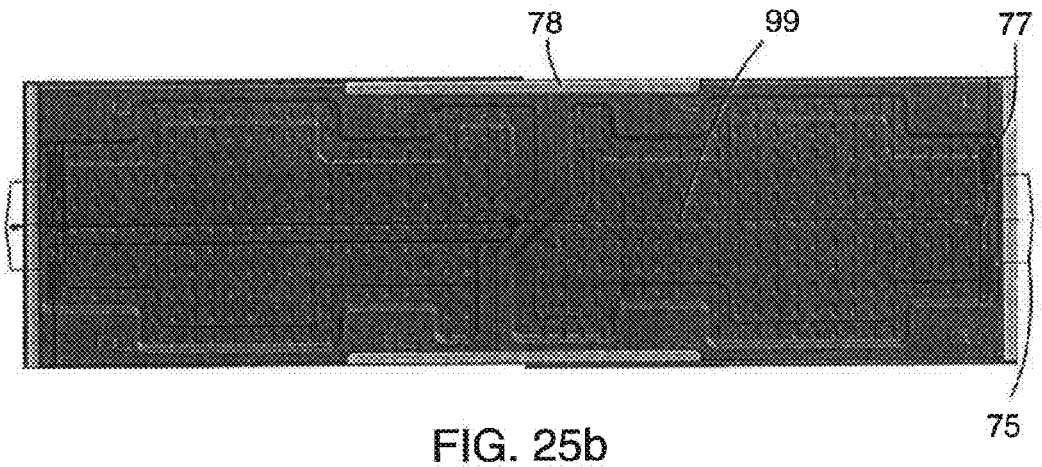
FIG. 25*b* is a perspective illustration of the wiring diagram of FIG. 25*a* in use on a panel unit according to another non-limiting aspect of the present invention.

FIG. 25*b* is a perspective illustration of the wiring diagram of FIG. 23 applied to the back surface of a completed panel unit. In one non-limiting embodiment, the LED wiring can be secured to the surface of the panel; however, this is not required.

Figure 26:
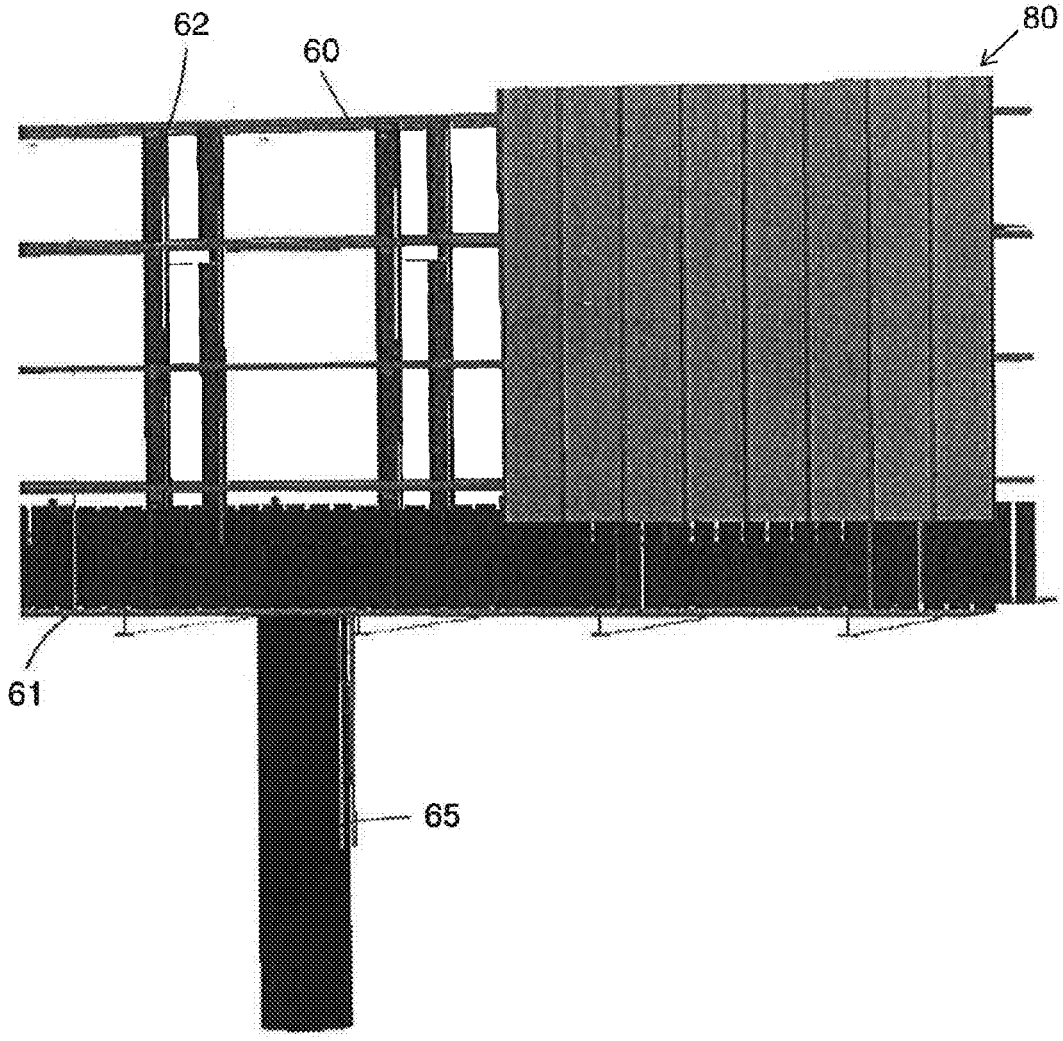
FIG. 26 is a front perspective view of assembled panel units hung on a billboard system according to another non-limiting aspect of the present invention.

As best seen in FIG. 26, a fully assembled LED billboard system comprises one or more assembled panel units 80. The overall dimensions of one non-limiting assembled panel unit are about 14' in height by about 4' in width. However, it can be appreciated that the assembled panel unit can have other dimensions. The unique structure of the assembled panel unit optionally permits easy and convenient attachment to stringers or to billboard structural supports.

Generally, twelve assembled panel units 80 can be assembled to fit a standard 14' by 48' billboard; however, this is not required. As can be appreciated, the number of assembled panel units can be varied to properly fit the structure and size of any pre-existing billboard. As such, the LED billboard system panels according to one non-limiting embodiment of the present invention are adaptable to pre-existing and future billboard structures.

Figure 27:
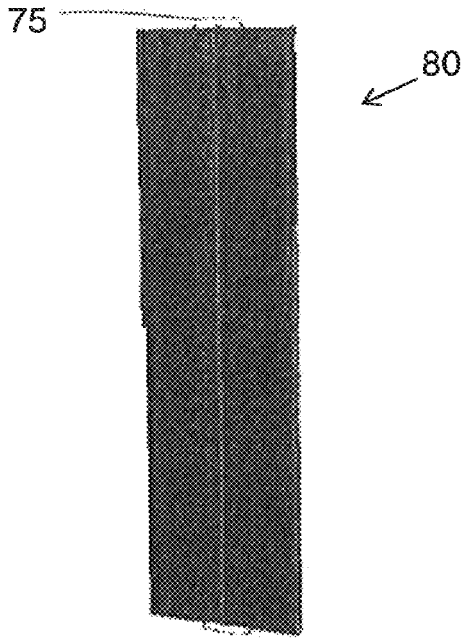
FIG. 27 is a perspective illustration of the front surface of an assembled panel unit according to another non-limiting aspect of the present invention.

FIG. 27 is a perspective illustration of one non-limiting embodiment of the present invention. One fully assembled panel unit 80 can be hoisted by a crane by hanging cable 75 and be placed on the billboard structure. Optional PBU clips can hook on to the stringers; however, this is not required.

Figure 28A:
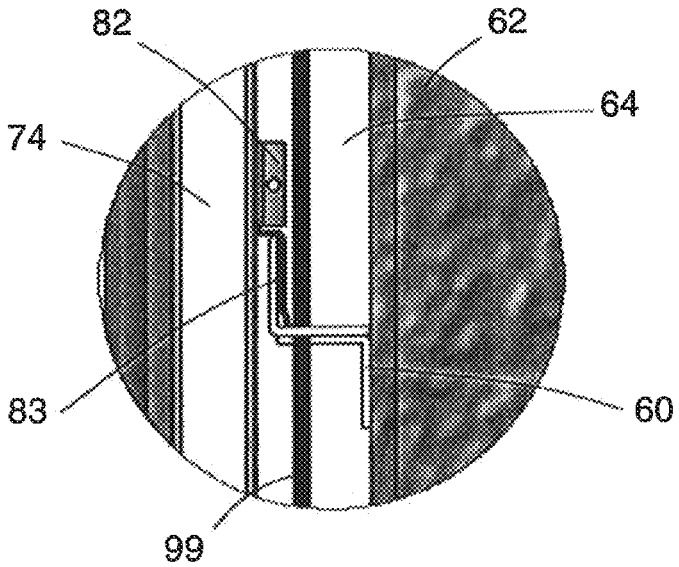
FIG. 28*a* is a zoomed-in perspective illustration of area "B" in FIG. 28*b;*
Figure 28B:
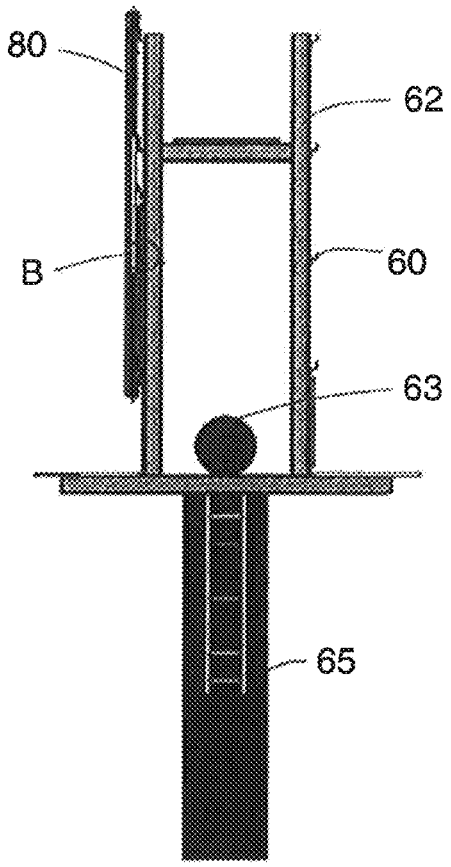
FIG. 28*b* is a side perspective view of the LED billboard system in use attached to the front face of a pre-existing billboard.

FIG. 28*a* is a zoomed-in perspective illustration of area "B" in FIG. 28*b*. As seen in the side-view perspective illustration of FIG. 28*a*, the PBU clip is hooked by the stringer; however, this is not required. As such, the flange 83 of PBU clip 82 is slid into the channel 64 created by stringer 60.

FIG. 28*b* is a side-view perspective illustration according to another non-limiting embodiment of the present invention. Stringers 60 mounted to the billboard structural support, support the weight of the assembled LED billboard system.

The gap in the stringer channel has tolerance, such that the workman on the sign and the workman operating the crane can maneuver the billboard panel onto the stringers. The sheer weight of each panel can hold the LED billboard system in place on the billboard. Furthermore, all the panels are buckled together, side by side, such that all the panels function together as a single sign unit. The weight of all twelve panels together is enough to resist moderate wind. The graphic wrap is stretched across the partial or entire billboard face and is tied down with hooks and straps at multiple points on all four sides. The hooks and straps can wrap around the front edges of the billboard, and hook securely to the backside of the billboard structure. Thus, the graphic wrap, having been stretched around the entire billboard face, secures all the billboard panels and led panels in their place. The security and stability is enough to resist even gale force winds.

Figure 29A:
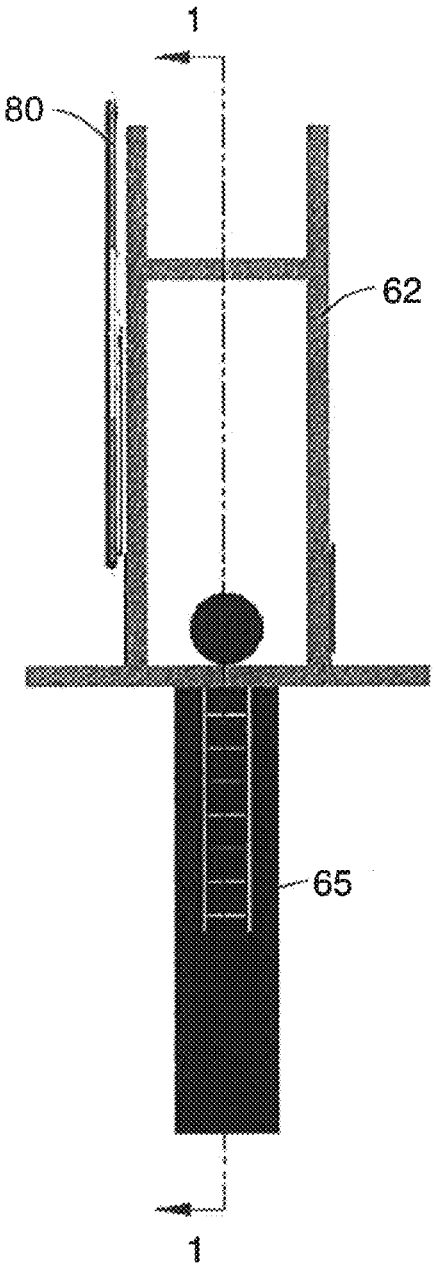
FIG. 29*a* is a side perspective view of an LED billboard system in use attached to the front face of a pre-existing billboard according to another aspect of the present invention.

Referring now to FIG. 29*a*, a side-view perspective illustration according to another non-limiting embodiment of the present invention is provided. Assembled panels 80 hang on the front faces of a billboard structure.

Figure 29B:
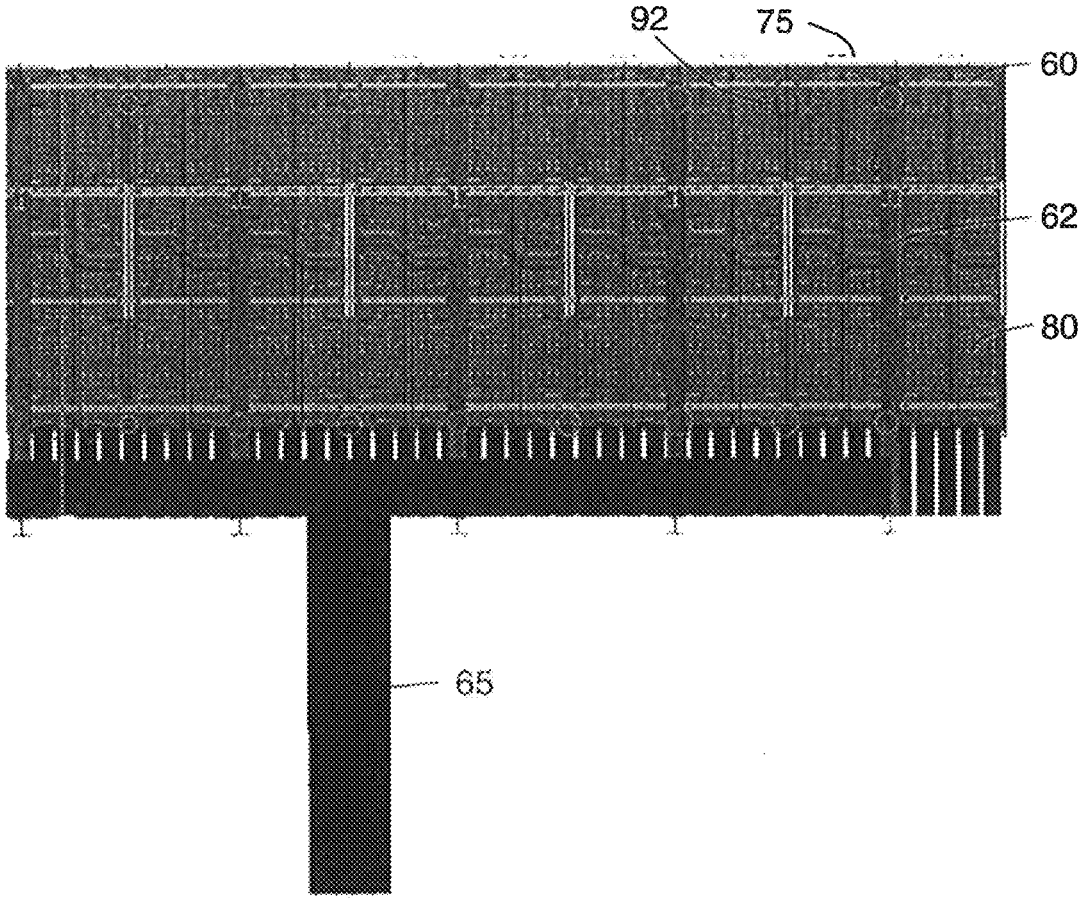
FIG. 29*b* is a cross-sectional view taken along 1-1 of FIG. 29*a;*

As seen in FIG. 29*b*, a cross-sectional view taken along line 1-1 of FIG. 29*a*, the fully assembled panel units, one of which is marked 80, are hung on stringers 60 and optionally clasped together. One or more compression spring catches 92 can clasp together, side-by-side, neighboring assembled panels 80; however, this is not required. As can be appreciated, other or alternative types of buckles or latches can be used.

Figure 30:
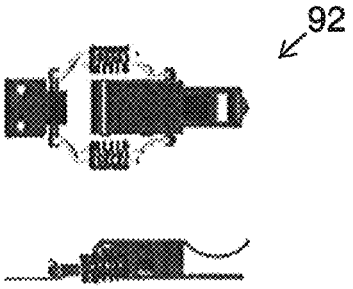
FIG. 30 is a perspective illustration of the buckle used to attach neighboring panels according to one non-limiting aspect of the present invention.
Figure 31:
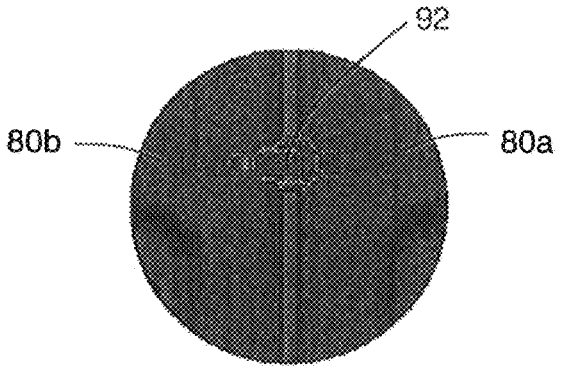
FIG. 31 is a perspective illustration of the buckle of FIG. 30 in use according to another non-limiting aspect of the present invention.

FIG. 30 is a perspective illustration of the compression spring catches in one non-limiting embodiment of the present invention.

FIG. 29 is a perspective illustration of the compression spring catches 92 in use, attached to neighboring panels 80*a* and 80*b* according to another non-limiting aspect of the present invention.

In non-limiting embodiments, 22 buckles can be used to complete the whole billboard; however, this is not required. As can be appreciated, the type and number of buckles/latches can be varied.

Figure 32:
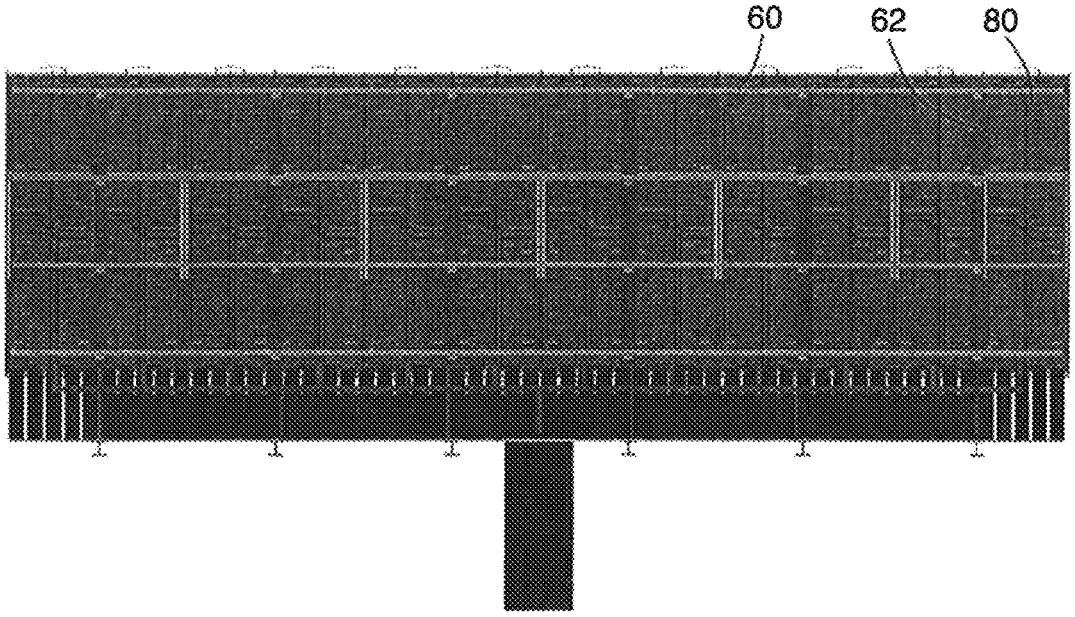
FIG. 32 is a perspective illustration of the back side of a fully assembled LED billboard system according to another non-limiting aspect of the present invention.

As seen in FIG. 32, twelve panels can be hung on a pre-existing billboard structure. The twelve panels units can be plugged in to receive electrical power; however, this is not required.

Figure 33:
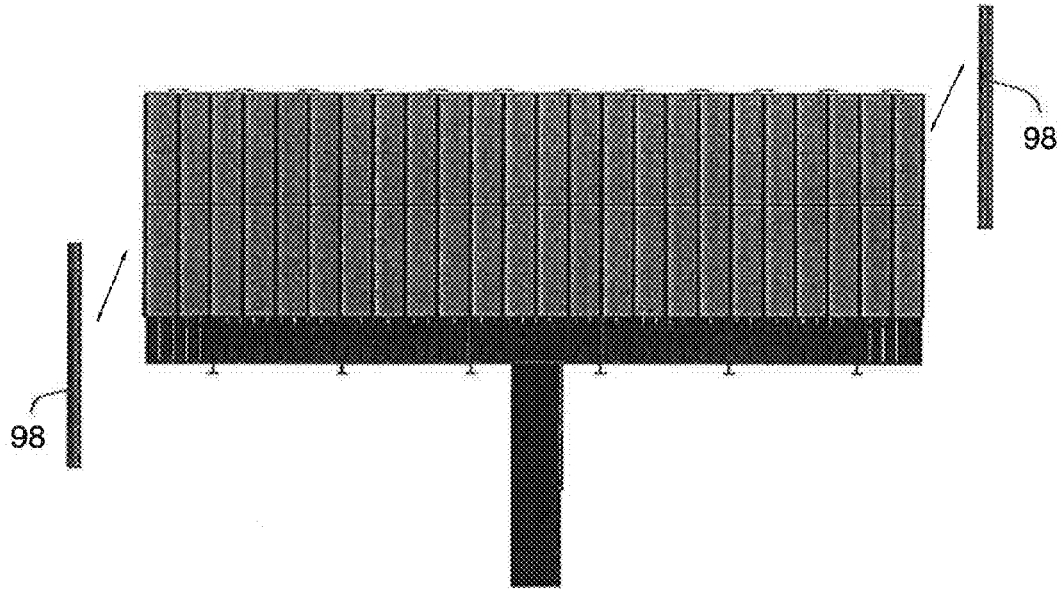
FIG. 33 is a perspective illustration of the front side of an assembled billboard system according to another non-limiting aspect of the present invention.

FIG. 33 is a perspective illustration of the front face of an assembled LED billboard system according to one non-limiting embodiment of the present invention. In use, twelve panel units are hung on the stringers and clasped together, side-by-side. The system can be completed by adding one or more additional baffle 98 to the far left and far right edges of the billboard system.

Figure 34:
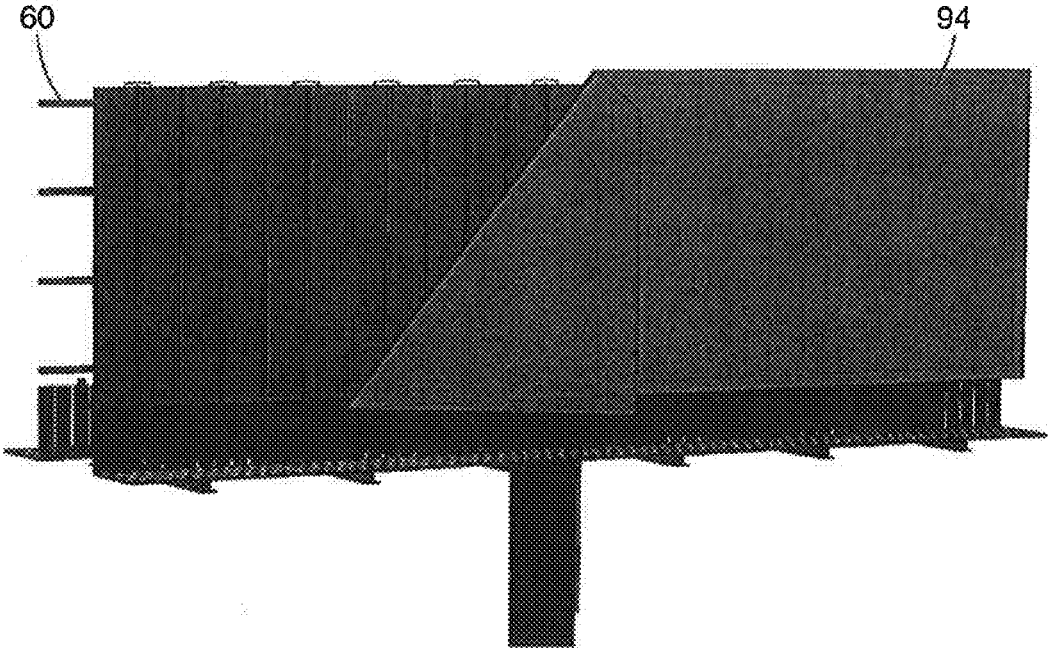
FIG. 34 is a perspective illustration of the LED billboard system in use according to one non-limiting aspect of the present invention.
Figure 35:
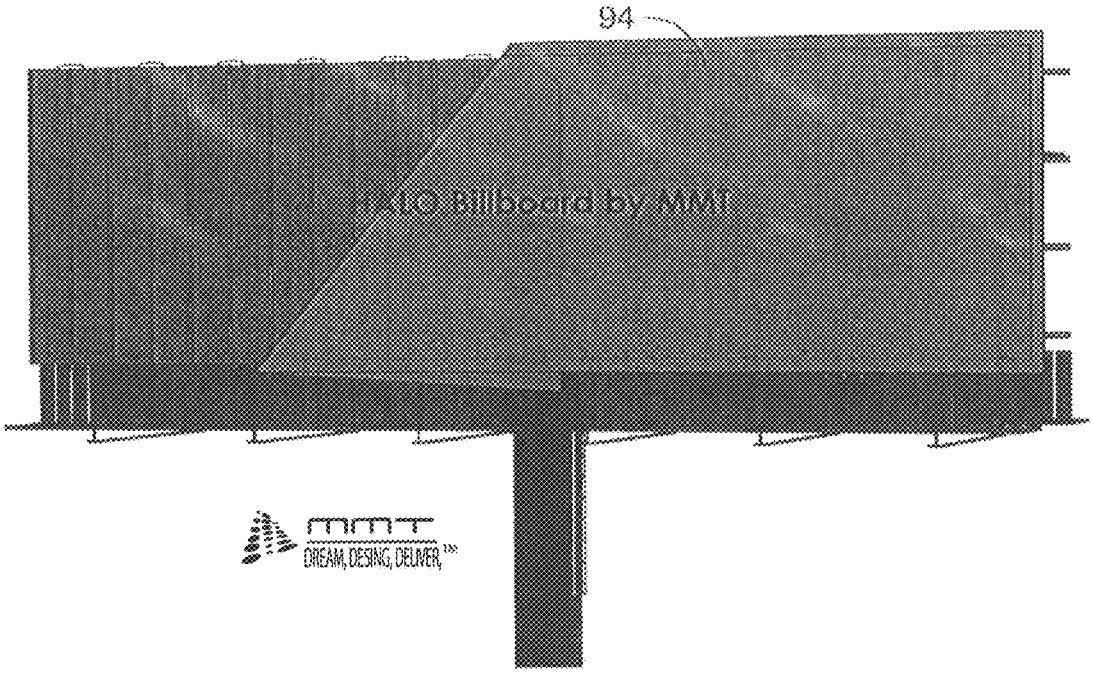
FIG. 35 is a perspective illustration of the LED billboard system in use according to another non-limiting aspect of the present invention.

In use, as best seen in FIG. 34, the LED billboard system is optionally attached to stringers 60 and covered by a graphic wrap 94. The graphic wrap is non-limiting and can be fabric or any other or alternative suitable material.

In one non-limiting method of installation, two identical panels can be fastened together using side brackets. Top-bottom brackets and one or more baffle can be fastened to the panels. LED light boards or LED carpet can be slid into the baffle channel of each panel unit. Three baffles can be used to create the baffle channels. The twelve fully assembled panel units can be hoisted to the billboard structure and can be attached to the pre-existing billboard structure. Buckle latches can be used to secure neighboring panels side-by-side. A graphic wrap can be hung across the partial or entire face of the billboard such that when the LED lights are switched on, the billboard can be illuminated from behind. As can be appreciated, other or additional quantities of components and methods of installation can be used.

Referring now to another non-limiting embodiment of the present invention as illustrated in FIGS. 36-42, an LED billboard system can optionally comprise panel subunits, top-bottom brackets, LED carpets, batons, one or more edge baffles, one or more center baffles, and a graphic wrap; however, this is not required. The LED billboard system can include other and/or additional parts.

Figure 36:
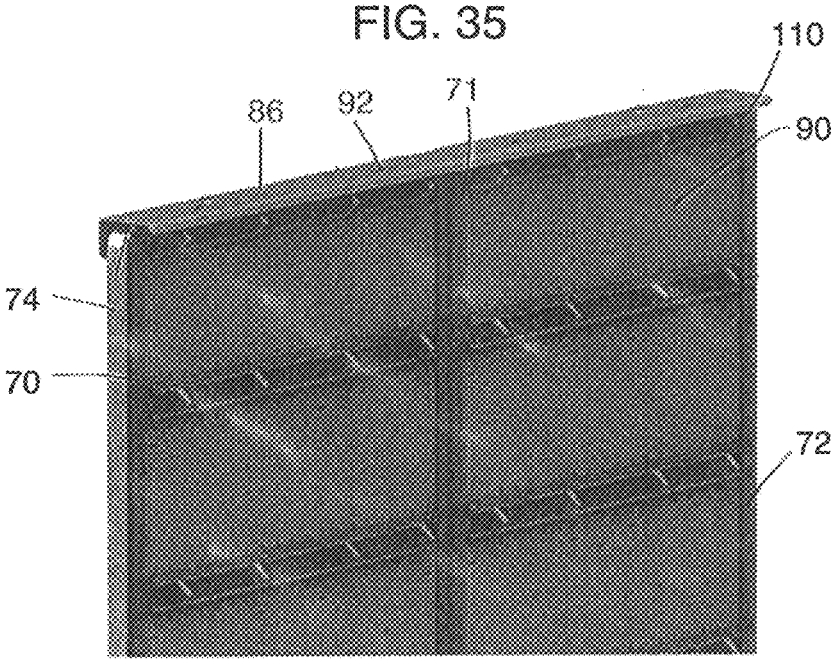
FIG. 36 is a perspective illustration of an LED billboard system according to another non-limiting aspect of the present invention.

FIG. 36 is a perspective illustration of an LED billboard system according to another non-limiting embodiment of the present invention comprising panel unit 74, baffles 70, 71, and 72, LED carpet 90, top-bottom bracket 86, cable 92, and baton 110; however, this is not required. The LED billboard system can include other and/or alternative components. Panel unit 74 can be blow-molded such that it is lightweight yet durable and sturdy for support; however, this is not required. Top-bottom bracket 86 can be a metal extrusion (e.g., aluminum extrusion, etc,) with a slot pattern and can be attached to the panel units 74 at the top and bottom of the billboard panel; however, this is not required. LED carpet 90 can include diodes patterned on a flexible circuit panel; however, this is not required. In non-limiting embodiments, each LED carpet can include a plurality of diodes (e.g., thousands of diodes, etc.); however, this is not required. The one or more batons 110 can be injection molded and snapped onto the LED carpet; however, other arrangements can be used. Batons 110 can serve multiple purposes, including reinforcing LED carpet seams, guiding the LED carpet into channels, and/or separating the graphic wrap from the surface of the LEDs. The LED carpets can be optionally slid into the channels created by baffles 70, 71, and 72.

Figure 37:
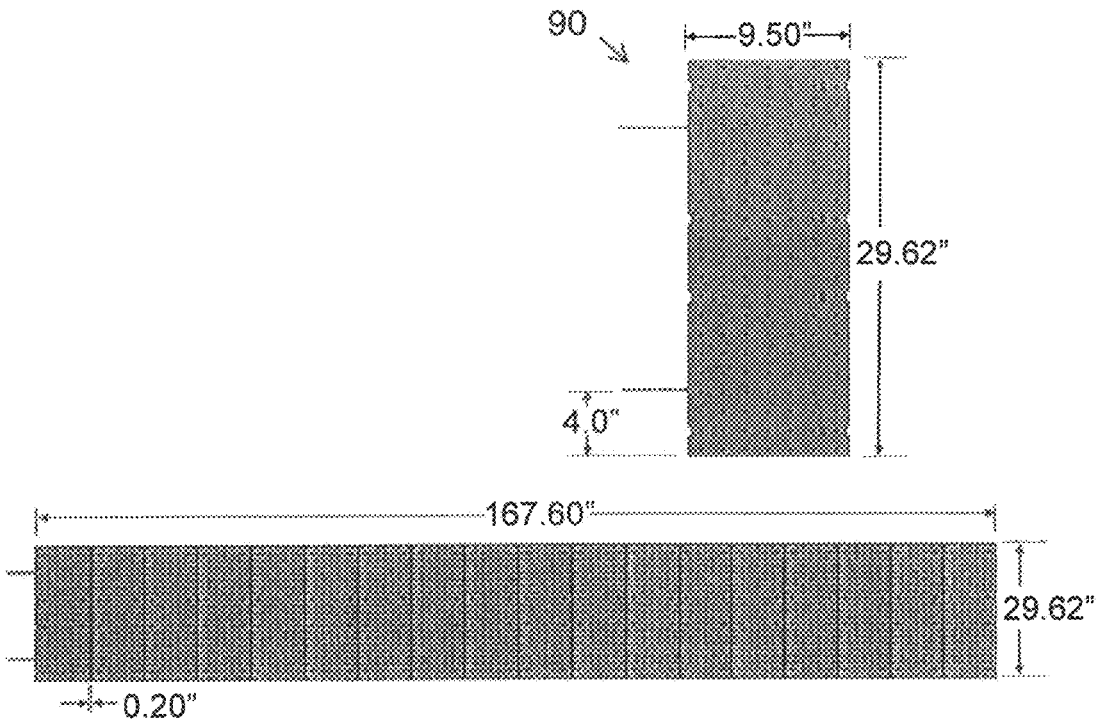
FIG. 37 is a perspective illustration of an LED carpet according to another non-limiting aspect of the present invention.

FIG. 37 is a perspective illustration of an LED carpet 90 according to one non-limiting embodiment of the present invention. The LED billboard system of the present invention can include one or more LED carpets; however, this is not required. One LED carpet, according to one non-limiting embodiment of the present invention, can be about 23.62 inches by about 9.50 inches and comprise a generally planar rectangular shape; however, it can be appreciated that the LED carpet can have other dimensions. As can be appreciated, the LED carpet can be other or alternative shapes. In one non-limiting embodiment, eighteen panels can be arranged, thereby providing an LED carpet about 23.62 inches by about 167.60 inches (i.e., about 2 feet by about 14 feet); however, it can be appreciated that any other number of panels can be arranged together. Neighboring LED carpets can be optionally overlapped (e.g., overlapped by about 0.20 inches, etc.); however, this is not required. The distance between the first LED to the long edge of the LED carpet (i.e., the 23.62 inch edge) can be about 0.765 inches; however, other distance can be used. The distance between the first LED to the short edge of the LED carpet (i.e., the 9.5 inch edge) can be about 0.410 inches; however, other distances can be used. In non-limiting embodiments, the pitch between LEDs can be about 1.332 inches by about 1.140 inches; however, other pitch values can be used. Two 24-volt wires can be attached to the bottom of each LED carpet wherein the wires are optionally located at a distance of about 4 inches from the side edges; however, this is not required. In one non-limiting embodiment, the LED carpets are LEDCONN; however, this is not required. As can be appreciated, other or alternative dimensions and/or arrangements and/or brands of LED carpets can be used.

Figure 38:
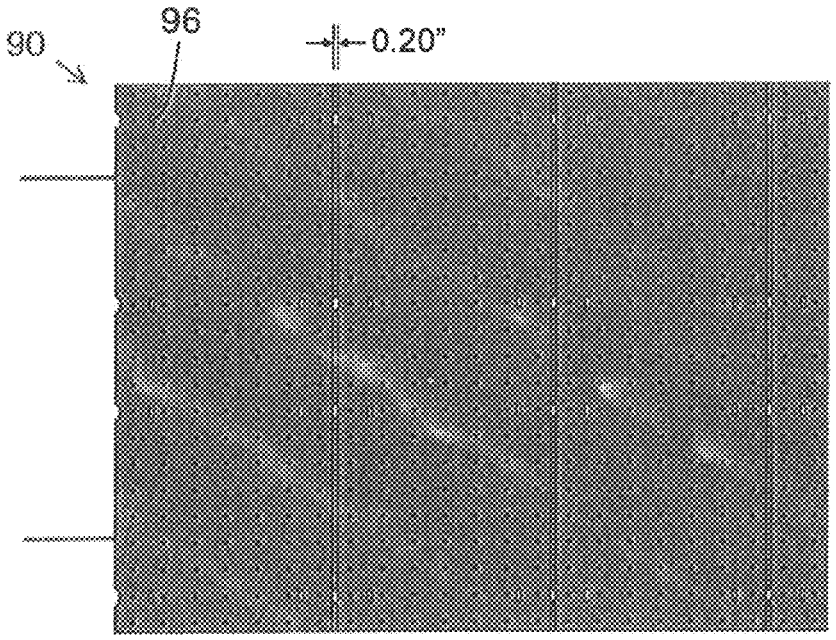
FIG. 38 is a perspective illustration of an LED carpet according to another non-limiting aspect of the present invention.

With reference now to FIG. 38, the LED carpets can be arranged side-by-side and joined along the LED carpets' long edge (i.e., the 23.62 inch edge); however, other arrangements can be used to orient and/or join the edges of the LED carpets. In non-limiting embodiments, neighboring LED carpets can overlap about O.2O inches; however, amounts of overlap or no overlap can be used. A jig could be used to hold the overlap seam so as to create a bond (e.g., adhesive bond, solder bond, welded bond, melted bond, etc.); however, this is not required. The one or more LED carpets 90 can include a plurality of slots or openings 96 defining a series of hole patterns for use in conjunction with one or more batons 110; however, this is not required. The series of hole patterns can accommodate the baton placed in different positions on the LED carpet. As such, the one or more slots 96 on LED carpet 90 permits a surface projection hook 120 of baton base 112 and/or some other structure to extend through the slot 96 thereby holding or at least partially securing the LED carpet in position.

Figure 39:
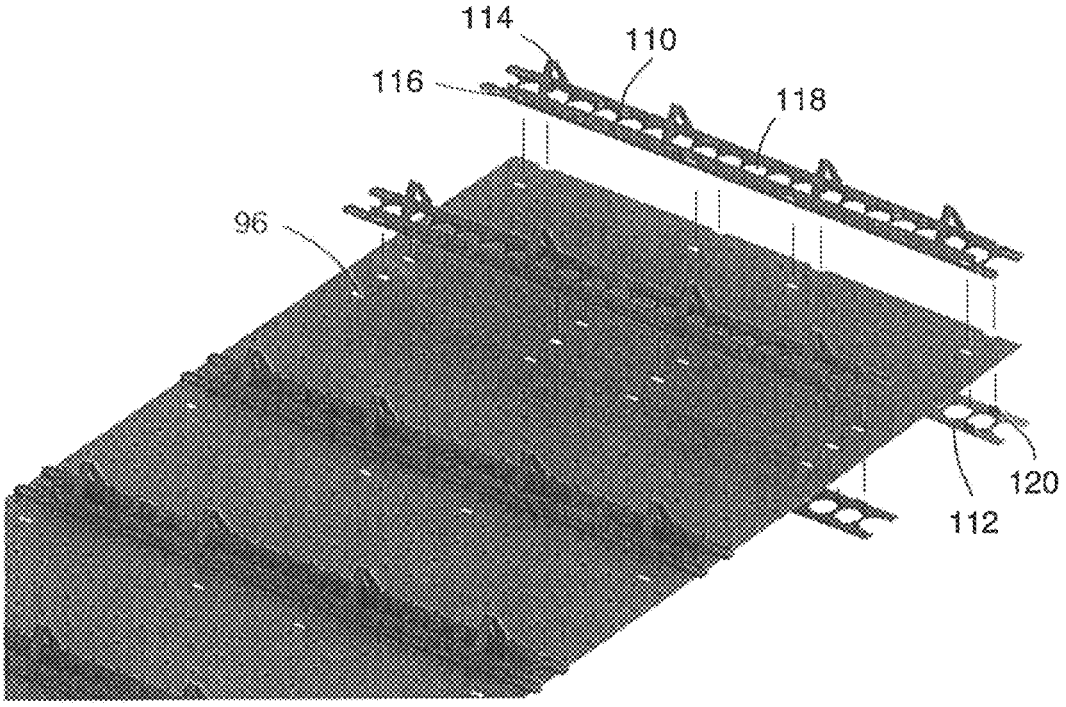
FIG. 39 is a perspective illustration of a baton system according to another non-limiting aspect of the present invention.

FIG. 39 is a perspective illustration of the one or more batons used in an LED billboard system according to another non-limiting embodiment of the present invention. The baton system can be a two-part, injection molded baton; however, this is not required. Optionally provided at or near the outer edges of baton 110 are one or more slots or openings 116; however, this is not required. The shape of slots 116 can be substantially rectangular so as to accommodate the surface projection hook 120 of base portion 112;

however, other shapes can be used. The one or more slots 116 can be optionally disposed on the baton 110 at locations corresponding with slots or openings 96 provided on LED carpet 90; however, this is not required. Optionally provided between the two edges of baton 110 are a plurality of openings, one of which is marked as 118, provided for the purpose of allowing light to pass through the baton; however, this is not required. The shape of the openings 118 can be circular; however, other shapes can be used. As such, the shape of the openings 118 can be designed to allow light from an LED diode to pass through the baton; however, this is not required. Baton 110 can include one or more surface projections 114 provided for the purpose of separating the overlaying graphic wrap from the underlying LEDs; however, this is not required. The shapes of the surface projections are non-limiting.

Baton 110 can include a base portion 112 comprising surface projection hooks extending perpendicular to the surface of the base portion 112; however, this is not required. As such, the extensions, one of which is labeled as 120, can extend upwardly and pass through slot 96 of LED carpet 90 and further through slot 116 of baton 110 such that the base 112 and baton 110 snap together or are held together by other means, thereby holding the LED carpet rigidly in place; however, this is not required. In non-limiting embodiments, the material of the baton can be clear, UV stabilized polycarbonate; however, other materials can be used. As can be appreciated, other or alternative materials can be used. One baton can be disposed at every seam of the LED carpet; however, this is not required. One baton can also be disposed at the top and bottom of the LED carpet; however, this is not required. In one non-limiting embodiment of the present invention, eighteen batons are provided for a LED carpet; however, it can be appreciated that other numbers of baton can be used.

Figure 40:
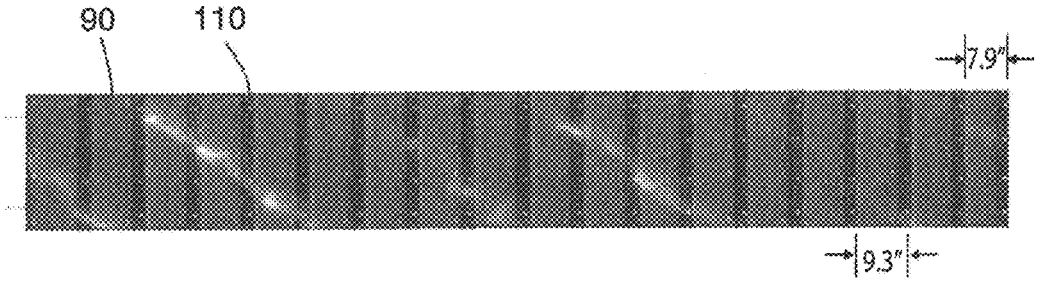
FIG. 40 is a perspective illustration of a baton system according to another non-limiting aspect of the present invention.

Referring now to FIG. 40, the one or more batons 90 can be arranged to cover the seam created between two neighboring LED carpets; however, this is not required. The first baton can be placed at or near the top edge of the LED carpet. The second baton can be about 7.9 inches down from the first baton and the next set of hole patterns of LED carpet 90 can be used. The remaining 16 batons can be patterned about 9.3 inches apart from each other; however, this is not required. As can be appreciated, other or alternative arrangements can be used. In one non-limiting embodiment, the baton at the bottom edge of the LED carpet is absent; however, this is not required.

Figure 41:
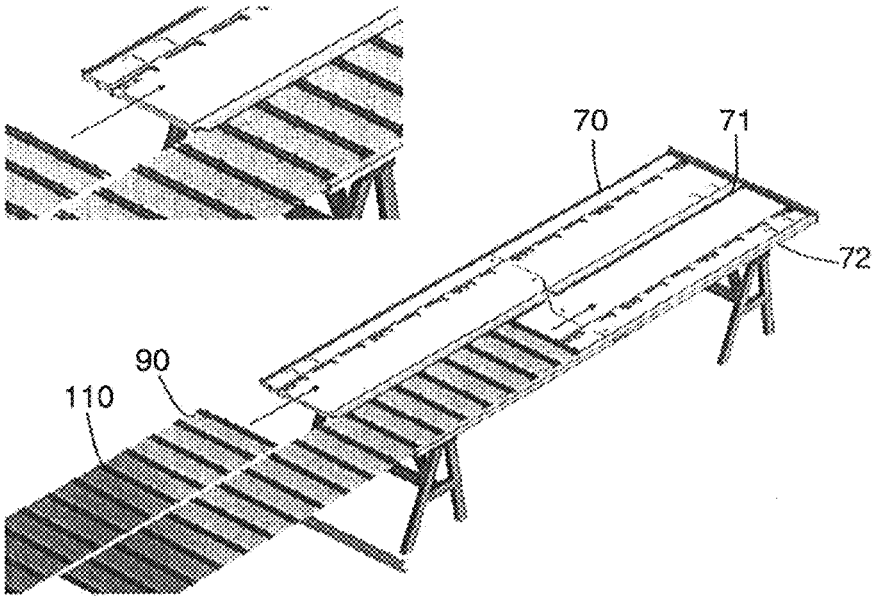
FIG. 41 is a perspective illustration demonstrating LED carpets in use in the LED billboard system according to another non-limiting aspect of the present invention.

FIG. 41 provides a perspective illustration demonstrating the installation of an LED carpet onto an assembled billboard panel. The LED carpet, one of which is marked as 90, can slide into channels created by baffles 70, 71, and 72. The LED carpets can be optionally unrolled and slid into the channels created by the baffles; however, this is not required. The batons 110 can protect the LEDs and give rigidity to the flexible circuit panel; however, this is not required.

Figure 42:
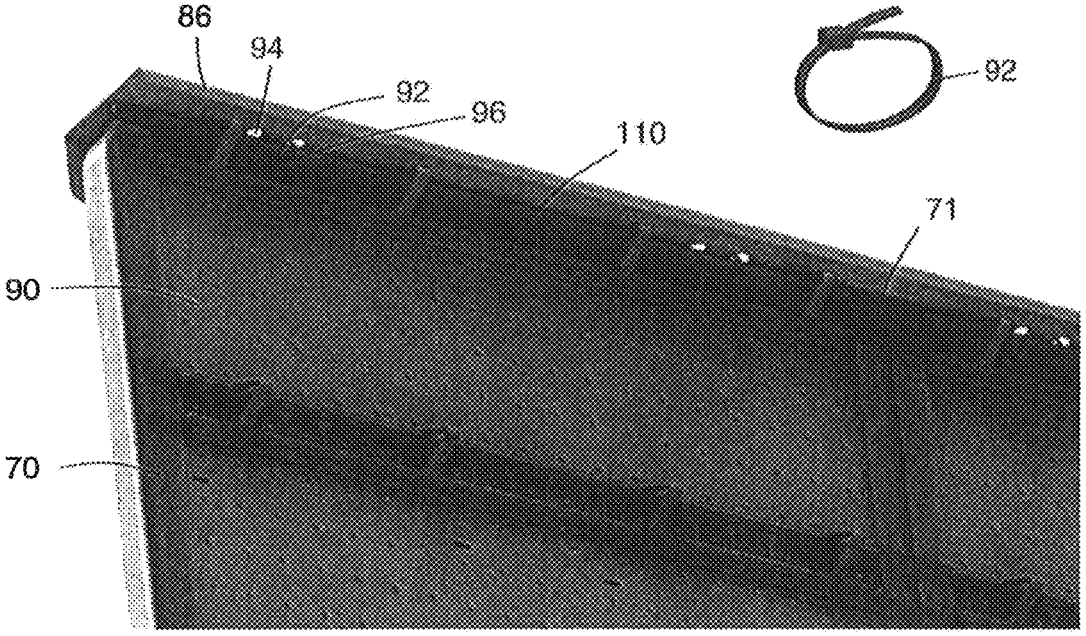
FIG. 42 is a perspective illustration of cable ties used in conjunction with the LED billboard system according to another non-limiting aspect of the present invention; and, FIG. 43 is a perspective illustration of the LED billboard system according to another non-limiting aspect of the present invention.
Figure 43:
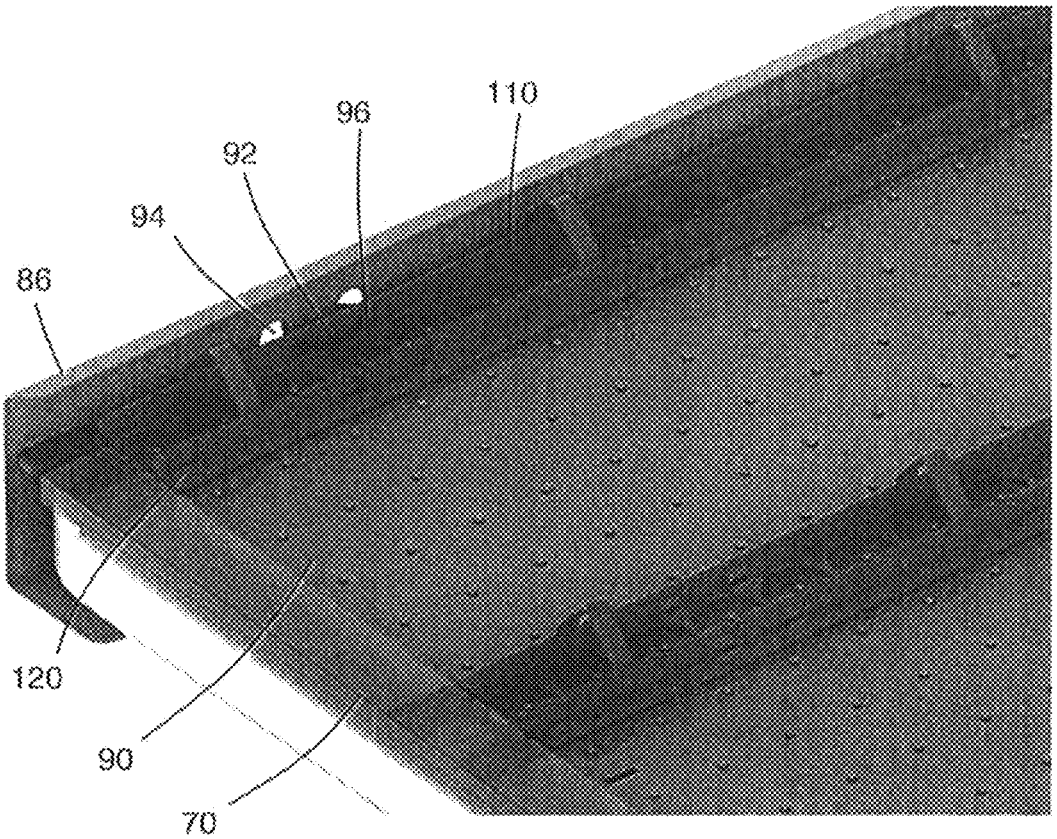

With reference now to FIGS. 42-43, the LED carpets can be optionally held in place at the distal ends (i.e., top and/or bottom ends) of the LED carpets. LED carpets 90 can be held in the channels on their longitudinal ends by baffles 70, 71, and 72 and also at the distal ends by top-bottom brackets 86. Generally, the weight of a flexible LED carpet may cause the LED carpet to slump, sag, etc. within the channels. As such, the LED billboard system of the present invention can be designed such that the LED carpets can be attached at the top and/or bottom edges to top-bottom brackets, thereby limiting or eliminating the slumping of the LED carpet. Top-bottom bracket 86 can include a plurality of slots or openings, one of which is marked as 94; however, this is not required. Similarly, the baton 110 can include a plurality of slots or openings optionally corresponding to slots or openings located on top-bottom bracket 86; however, this is not required. As such, a cable can be strung through the slot 94 of top-bottom bracket 64, and the slot 96 of top baton 110, and tied thereby hanging the LED carpet in place. In non-limiting embodiments, the cable can be a nylon zip tie; however, this is not required. As can be appreciated, other types of cables can be used. In some non-limiting embodiments, two zip ties are used for every one LED carpet; however, this is not required. The quantity of zip ties can be more or less than two. Thus, the LED carpets can be held in place within the channels and are further prevented from sliding out.

One non-limiting advantage of the present invention is the unique structure of the LED billboard system. In this regard, the LED billboard system of the present invention is an electroluminescent billboard, separating it from traditional spot lamp billboards and digital billboards.

Another non-limiting advantage of the present invention is the location of the lighting source. When the LED panels are switched on, the billboard is illuminated from behind.

Yet another non-limiting advantage of the present invention is the LED billboard system can be used for both outdoor and indoor applications.

As can be appreciated by any non-limiting embodiment of the present invention, the LED billboard system can be adapted to fit on an existing support structure of a billboard (e.g., when a traditional billboard graphic needs to be replaced without replacement of the underlying support structure, etc.). As such, the existing support structure of a billboard may provide a plurality of structural crossbars to which the LED billboard systems of the present invention can be attached.

The LED light provided by the billboard system of the present invention can optionally provide a static image; however, this is not required. For example, by changing or varying the wavelength of light produced by the LEDs, the image could be made to appear to be moving or changing over time and, thus, be non-static.

In other or alternative non-limiting embodiments of the present invention, light reactive inks and/or dyes can be provided on the graphic cover wrap such that the ink can react with the light emitted from the light boards to provide multiple effects; however, this is not required.

In another non-limiting embodiment of the present invention, the color of the LED backlight created by the LED light boards is white; however, this is not required. As can be appreciated, the standard color of light emitted by the LED lights can be other or additional colors. The LEDs used can be single color or multi-color with multiple chips mounted on the same substrate. For example, a common colored LED has four chips: red, green, blue, and white optionally mounted in the same package and optionally separately used in order to selectively vary the color output.

The use of LED light in the present invention and present indoor/outdoor application provides several advantages. For example, the LED lights emit narrow wavelength bands of light in red, green, blue, ultraviolet, and/or infrared. The narrow wavelength of bands makes it possible to shield the ambient light of a different wavelength with optical filters, thus enhancing the image contrast. As such, the LED billboard will appear brighter, clearer, and more visible to all viewers. By adjusting the wavelength and color of light emitted, different images can optionally be created.

The LED billboard system of the present invention provides vast improvements to billboard technology manufacturing, installation and assembly, product life span, maintenance, and consumer satisfaction.

The invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

The invention claimed is:

1. A free standing billboard for displaying information and adapted for attachment to a pre-existing billboard structure comprising:

(i) a graphic wrap;

(ii) one or more panel units, each of said panel units comprising:

(a) two panel subunits;

(b) one or more rollable LED carpet units affixed to each of said panel subunits;

(c) a bracket means for joining said subunits to each other;

(d) a latching means attached to each of said panel units; and (e) a baffle means having one or more batons appended thereto mounted to said panel unit and positioned between said graphic wrap and said LED unit.

2. The free standing billboard of claim 1, wherein said panel unit has dimensions of about 14'×4'×6".

3. The free standing billboard of claim 2, comprising 12 panel units.

4. The free standing billboard of claim 1, wherein said LED units comprise aluminum and acrylic.

5. The free standing billboard of claim 1, wherein said LED units have an edge lit configuration.

6. The free standing billboard of claim 1, wherein said LED units comprise a light scattering portion on their surface positioned opposite said graphic wrap.

7. The free standing billboard of claim 1, wherein said LED units comprise LEDs on a nontransparent material.

8. The free standing billboard of claim 1, wherein each of said LED units have dimensions of about 14'×2'.

9. The free standing billboard of claim 1, wherein each of said LED units comprise a back diffuser portion.

10. The free standing billboard of claim 1, further comprising a pair of electrodes attached to a power supply.

11. The free standing billboard of claim 1, wherein each panel subunit a flange means for overlapping another panel subunit.

12. The free standing billboard of claim 1, wherein said panel subunit is made of blow molded polyethylene.

13. The free standing billboard of claim 1, wherein each of said LED units further comprise a controller.

14. The free standing billboard of claim 1, wherein each panel subunit comprises a recessed zone for engagement of said bracket means.

15. The free standing billboard of claim 1, wherein each panel subunit comprises a flat zone to which a PBU clip is fastened.

16. The free standing billboard of claim 1, wherein each panel subunit further comprises a pair of brackets, attached to the top and bottom borders of said subunit.

17. The free standing billboard of claim 1, wherein said baffle means are clear.

18. The free standing billboard of claim 1, wherein said baffle means comprises openings on one or more sides.

19. The free standing billboard of claim 1, further comprising a light dispersing means.

20. The free standing billboard of claim 1, wherein said baffle means comprise a bottom plate having a vertical plate extending perpendicularly from an edge of said bottom plate and a horizontal plate connected to said vertical plate to form a channel therebetween, and further comprising a hollow tube positioned on said horizontal plate.

21. The free standing billboard of claim 1, wherein said one or more batons are of triangular shape, wherein the apex of the triangular shape extends away from said baffle means and the base of said triangular shape is positioned on said baffle means.

22. A process for manufacturing the free standing billboard of claim 1, comprising:

(a) connecting two panel subunits each of which has a front side and a back side to each other via a pair of side bracket means to create a panel, (b) applying a baffle means to the front side of each panel subunit, (c) affixing one or more rollable LED carpet units to each of said panel units and affixing said rollable LED carpet units to said baffle means, (d) attaching a plurality of said panels to each other via flange means which engage with each other, (e) attaching a graphic wrap to a structure produced in (d), and, (f) appending a latching means to the structure of (d) for engagement of said structure to a support.

23. The process of claim 22, comprising attaching 12 panel units to each other.

24. The process of claim 22, further comprising attaching a scattering means to said rollable carpet units.

25. The process of claim 22, further comprising affixing a diffuser to said free standing billboard.

26. The process of claim 22, further comprising affixing a bracket means to the top and bottom of each panel subunit for engagement of a further subunit.

* * * * *